United States Patent [19]

Gillum

[11] 4,348,938

[45] Sep. 14, 1982

[54] TWO STAGE SHELL FEEDING APPARATUS WITH SHELL FEEDING PATH CONTROL

[75] Inventor: Richard R. Gillum, Marblehead, Ohio

[73] Assignee: ARES, Inc., Port Clinton, Ohio

[21] Appl. No.: 89,308

[22] Filed: Oct. 30, 1979

[51] Int. Cl.[3] ..... F41D 10/04

[52] U.S. Cl. ..... 89/33 BA; 89/138

[58] Field of Search ..... 89/33 BA, 33 BC, 33 CA, 89/138, 33 D

[56] References Cited

U.S. PATENT DOCUMENTS

| | | | |
|---|---|---|---|
| 2,091,672 | 8/1937 | Cleereman | 89/33 D |
| 2,357,127 | 8/1944 | North | 89/33 CA |
| 2,378,191 | 6/1945 | Corte | 89/33 BC |
| 2,830,498 | 4/1958 | Maillard | 89/33 BA |
| 2,983,196 | 5/1961 | Dixon | 89/33 CA |
| 3,757,636 | 9/1973 | Chiabrandy | 89/169 |
| 3,875,845 | 4/1975 | Hupp et al. | 89/33 CA |

*Primary Examiner*—Stephen C. Bentley
*Attorney, Agent, or Firm*—Allan R. Fowler

[57] ABSTRACT

Two stage shell feeding apparatus for a reciprocating bolt-type automatic cannon or gun, comprises a first stage shell rotor, having a plurality of shell cavities, rotatably mounted between a shell supply and a cannon shell pick up position, such that when a shell in one of the rotor cavities is in the shell pick up position, an empty rotor cavity is in shell receiving relationship with the shell supply. After firing of the cannon and while the bolt is recoiling rearwardly, barrel gas operated actuating means cause rapid partial rotation of the rotor to index a rotor carried shell into the pick up position. A spring actuated, second stage shell advancing slide is simultaneously cocked to enable subsequent spring powered transferring of a free shell from the shell supply into the aligned rotor cavity during the remainder of the firing cycle. Shell accelerator means are provided to cause shell acceleration before bolt pick up impact. Configuration of the rotor cavities, a pair of feed lip members adjacent the shell pick up position and shell deflector means control movement of shells from the pick up position into a cannon firing chamber.

31 Claims, 36 Drawing Figures

TWO STAGE SHELL FEEDING APPARATUS WITH SHELL FEEDING PATH CONTROL

The present invention relates to the field of shell feeders for automatic guns, and more particularly to shell feeding apparatus for rapid fire, automatic cannon.

An extremely difficult role in modern warfare is defending targets against low level, relatively close-in attack by enemy aircraft. Because of difficulty in detecting fast, low flying aircraft at sufficiently far distances to enable effective use of surface-to-air missiles, this critical defensive role is typically assigned to antiaircraft weapons systems utilizing rapid fire, automatic cannon.

As a result of tradeoffs among such factors as range, trajectory, firepower, mobility and cost, automatic cannon in the calibre range of 30–40 mm are commonly used in this role. Maximum range of these type cannon is at least about 5000 meters; however, when used against low level aircraft attacking at speeds up to about Mach 1 (approximately 340 meters per second at sea level) the most effective target range has generally been found to be between about 1000 and 3000 meters.

Because of their relatively high attack speed, low level and maneuvering, attacking aircraft in the mentioned optimum effective range can ordinarily be tracked for only a few seconds during each attack pass. Therefore, to enable a sufficiently high target aircraft hit and kill rate to protect vital targets and deter attack, the antiaircraft guns must be capable of such rapid firing rate as to provide a defensive curtain of fire or shot gun effect.

In consequence, although usually fired only in short bursts of 10–20 rounds because of generally limited shell capacity, instantaneous firing rates of individual antiaircraft cannon used for close-in defense must be at least several hundred rounds per minute. Thus, as an illustration, typical gas operated, automatic 35 mm cannon of the type commonly used in antiaircraft systems have instantaneous firing rates of about 500–600 rounds per minute. Ordinarily these cannons are used in pairs to increase the firing rate to between 1000 and 1200 rounds per minute.

Other types of substantially faster firing automatic cannon, for example, multi-barrel, Gatling-gun types and multi-chambered revolver types which may have more than one barrel, have been developed and are available. However, for a number of reasons, such types are principally designed for airborne applications and are not widely used for ground based antiaircraft roles, at least not in those requiring high mobility and calibres greater than about 20 mm.

A disadvantage of multi-barrel guns is that, because of being relatively massive in large calibres as a result of the several barrels used, the cannon require greater amounts of power during operation to rotate the barrels than is ordinarily available or feasible for mobile antiaircraft systems. An additional disadvantage is that as the barrels are being rotated up to full speed, the first few shells fired are usually thrown off target in an unpredictable manner. This causes initial portions of each burst to be generally ineffective and wasteful of shells. Although not necessarily of severe disadvantages to small calibre cannon having large capacity ammunition belts, this characteristic is very disadvantageous for large calibre cannon having only limited shell supplies and firing only in short 10–20 round bursts. A still further disadvantage of multi-barreled guns, as well as of multi-chambered revolver-type guns, is that unfired shells left in the barrels (or chambers) at the end of a burst are susceptible to being inadvertently fired by heat from the barrel or chamber walls. Unless these shells are quickly ejected, hence being wasted, potentially disastrous "cook off" shell firing may occur.

Accordingly, assuming use of generally conventional, gas operated cannon for close-in air defense weapons systems, improvements increasing individual cannon firing rates are necessary to offset continually improved performance of attacking aircraft and their associated attack weaponry. Even in applications in which existing cannon firing rates are not unacceptable, improvements are needed to increase reliability, since the cannons are operating at their current limits of capability.

Because commonly used, gas operated antiaircraft cannon operate on an axially reciprocating bolt principle, in which shell loading and firing occur on a forward bolt stroke and fired shell casing extraction and ejection occur on a rearward bolt stroke, firing rates are dependent on bolt cycling time. Accordingly, any increase in firing rate requires a decrease in bolt cycling time, by increasing bolt speed and/or by reducing length of the bolt stroke.

Bolt speed is, however, normally limited by mechanical stresses caused by rapid acceleration and deceleration of relatively massive moving bolt assemblies and from shell pick up impact forces. As a typical example, bolt assemblies of 35 mm cannon may weigh about 20 pounds, the shells weighing about 3.5 pounds. To prevent stress damage or excessive wear of parts, maximum allowable 35 mm bolt speed is currently between about 50–60 feet per second.

Length of the bolt stroke is, on the other hand, determined to a great extent by the distance needed for picking up a shell and moving the shell inwardly towards the bore axis and forwardly into the breech. Given a specific bolt forward speed, bolt stroke length is also dependent upon the time required for feeding a shell into the bolt pick up position between shots.

As is readily apparent, as bolt speed is increased and bolt stroke is decreased to increase firing rate, allowable shell feed time is decreased, as is length of the shell path after pick up. Consequently, limitations on reliable feeding of shells ordinarily dictate firing rate of automatic cannon, shell feeding improvements being necessary to further increase firing rate of such weapons. As illustrations of problems encountered at high bolt velocities and short bolt strokes, shells may sometimes not be fed fast enough to be in position for picking up by the bolt. As a result, the bolt closes on an empty chamber and firing is interrupted while the cannon is recharged. If the shell feed path after pick up is marginally short, shells may become jammed as they are driven forwardly, causing gun jamming and possibly also dangerous impact-caused firings.

Belt feeding of shells, as is commonly used for machine guns and small calibre cannons, generally cannot be used, at least alone, for feeding shells to large calibre, rapid firing automatic cannon. This is principally because of the difficulty in rapidly advancing, without damage, even relatively short portions of a fully loaded belt of large calibre shells, due to combined weight of the shells. Even if sufficient belt drive power can be provided, usually from a source external to the cannon, without causing slowing of the cannon firing rate, the required great belt advancing forces tend to pull belt links apart or to damage shells to an extent making both shell feeding of the cannon and fired shell casing extraction and ejecting difficult and unreliable.

As an alternative to belt feeding, shell magazines are used by most gas operated antiaircraft cannon. As a typical example, in the shell feed apparatus used with Oerlikon 35 mm antiaircraft cannon, shells are clip fed into a magazine attached to the cannon. Within the magazine, the shells are stripped from the clips and are then fed into a segmented, endless conveyor which then advances the shells to a cannon shell pick up position. A typical Oerlikon 35 mm cannon magazine holds seven, seven round clips, the conveyor advancing a series of eight shells. External power, including an electrically wound, mechanical spring motor, operates the Oerlikon magazine.

However, even with external power, the conveyor when advancing eight shells, weighing a total of about 28 pounds, cannot be driven fast enough, without damage to the shells or conveyor, to enable firing rates much greater than about 550 rounds per minute. Furthermore, since the magazine spring motor is capable of feeding only about 10 shells before unwinding, the spring must be continually rewound by the associated electric motor. If the auxiliary electric power is lost, for example, due to battle damage, the spring motor must be manually wound at least every ten rounds. When this is necessary, ability to rapidly fire series of bursts, as is often necessary in combat situations, is greatly impaired and effectiveness of the entire weapons system is consequently dangerously reduced.

Because of these and other problems with heretofore available (or disclosed) shell feeding apparatus for automatic cannon, applicant has invented an improved, two stage shell feeding apparatus which enables rapid, reliable shell feeding without shell or feeding damage and at high firing rates, without necessity for an external source of power. In addition, applicant's apparatus provides controlled shell feeding from the shell pick up position to the cannon breech, thereby enabling reducing of bolt stroke length with subsequent reduction of bolt cycling time and increase in firing rate or enabling improved feeding at current firing rates.

Accordingly, for a gun having a bolt operative for axially reciprocating past a loaded shell pick up position which is offset from the barrel bore axis of the gun, to sequentially pick up shells therefrom on forward bolt travel for loading into a gun firing chamber, applicants' two stage shell feeding apparatus comprises a first stage shell feeding rotor having surface regions defining a plurality of peripheral shell holding cavities spaced apart around the rotor, and shell supply means for supplying shells, as free shells, to the rotor. Means are provided for rotatably mounting the rotor for enabling transfer thereby of shells from the supply means into the shell pick up position. The rotor mounting means are configured for positioning the rotor relative to the shell supply means and the shell pick up position for causing, when any one of the rotor cavities is indexed into the shell pick up position, another one of the rotor cavities to be positioned in shell receiving relationship with the supply means.

Included in the apparatus are relatively fast first stage actuating means operated by pressurized gases from firing of the gun, for causing, after the gun is fired and prior to the recoiling bolt moving rearwardly of the shell pick up position, partial rotation of the rotor to index a rotor cavity holding a shell into the shell pick up position to enable picking up of the shell by the bolt on subsequent forward bolt travel and simultaneously to index an empty cavity, preferably a cavity adjacent to the cavity in the pick up position, into shell receiving relationship with the supply means.

Relatively slow second stage shell feeding means, operated by pressurized gases from the same firing of the gun, are provided for causing, after the first stage actuation means has rotatably indexed the rotor and before a next firing of the gun, the advancement of a plurality of shells in the supply means toward the rotor and the transfer of a free free shell from the shell supply means into the empty rotor cavity indexed therewith with the rotor being completely isolated from the shell supply during shell feeding rotor rotation, resistance to said shell feeding rotor rotation being thereby minimized.

This structure permits the fast rotor action to occupy only a minor part of the firing cycle (the time between successive firing of shells during automatic firing), so as to leave the major part of the firing cycle for the advancement of a plurality of shells in the shell supply and the feeding of a free shell into an empty rotor cavity indexed with the supply. This results in a faster and smoother operating over-all feeding apparatus, especially for cannon-size shells, and enables the cannon to fire at a higher rate of fire.

In the illustrated embodiment of the invention, the relatively fast rotor actuating means is operatively coupled to the relatively slow shell feeding means to produce, upon each sequential firing of a shell, sequential operation, first of the actuating means within approximately the first 25% of the firing cycle, and thereafter the shell advancement and transfer of the shell feeding means during the remainder of the firing cycle.

Further, because a free shell is supplied to the rotor, as opposed to running belted or linked shells through the rotor, the rotor operation is isolated from the shell supply, and is not required to pull on a series of linked rounds. Since the shells in the rotor are free (as opposed to linked), a shell retaining means may be mounted intermediate the rotor and the cannon adjacent the shell pick up position for retaining in the rotor a free shell disposed in whichever rotor cavity is indexed into the shell pick up position.

The illustrated embodiment of the invention, includes various implementing features.

More specifically, the rotor mounting means include a rotor shaft mounted for bidirectional rotation, the rotor being rotatably mounted on the rotor shaft. Means are included for limiting rotor rotation to a single shell indexing direction while ratchet means are provided for interconnecting the rotor to the rotor shaft for enabling shell indexing rotation of the rotor by the rotor shaft and subsequent return rotation of the shaft without rotor back up movement.

The first stage actuation means is connected to a first end of the rotor shaft and second stage actuation means, configured for actuating the second stage feeding means, are connected to a second end of the rotor shaft.

To prevent overtravel of the rotor and movement of the shell indexed into the shell pick up position out of such position, anti-surge means are provided for locking the rotor against rotational movement during shell transferring of a shell from the supply means into the empty rotor cavity by the second stage feeding means. The ratchet means are configured for causing disengagement or unlocking of the rotor from the anti-surge means during initial shaft rotation in response to a next firing of the gun and before subsequent rotational indexing of the rotor by the first stage feeding means.

Comprising the rotor shaft are a tubular main shaft, to opposite ends of which first and second actuation means crankarms are fixed, having disposed axially therethrough an elongate torsion bar. The torsion bar, fixed against rotation at a first end and nonrotatably connected to the main shaft at a second end, provides rapid return rotation of the main shaft without requiring any return driving forces from the second stage feeding means which might slow operation thereof. The rapid return rotation of the main shaft enables rotor locking by the anti-surge means before second stage shell transferring into the rotor is completed to prevent rotor overdriving.

Shell retaining means are mounted intermediate the rotor and the gun adjacent to the shell pick up position for retaining in the rotor a shell contained in whichever rotor cavity is indexed into the shell pick up position. Configuration of the shell retaining means permits forward extraction of the shell from the indexed cavity by the bolt on forward travel thereof past the shell pick up position. The shell retaining means include first and second feed lip members laterally spaced apart a distance enabling shell pick up engagement therebetween, by the bolt, of a shell contained in the rotor cavity indexed into the shell pick up position. The lateral spacing distance increases toward the front of the pick up position so that the shell feeding lips are diverging in that direction and are spaced and contoured to continuously engage and guide the forwardly stripped shell toward the cannon firing chamber along a substantial portion of the shell path.

Means are also provided for enabling the bolt to be seared up at the end of a burst in a fully charged condition in readiness for a next firing, when conventional searing up would otherwise require recharging of the gun before a subsequent firing. Such means include sensing means for sensing when no shell is in the rotor cavity indexed into the shell pick up position and no shell is in a next-to-the-last shell position, relative to shell transferring to the rotor, in the shell supply means. An electrical signal adapted for initiating bolt searing up the next time the bolt is in a searing up position rearwardly of the pick up position, is provided in response to sensing that the shell pick up position and the next-to-the-last shell position are simultaneously empty of shells.

When the rotor is configured so that whenever one cavity is indexed into the shell pick up position, an adjacent cavity is in shell transferring relationship with the shell supply means, firing is thus stopped with shells contained in both the cavity indexed into the shell pick up position and the next adjacent cavity indexed in shell receiving relationship with the shell supply means.

The first stage actuation means includes a gas cylinder having a piston, a crankarm fixed to one end of the rotor mounting shaft and means pivotally interconnecting the piston to the crankarm. Included are means for supplying pressurized barrel gases to the cylinder to cause movement of the piston, and hence rotation of the rotor shaft and rotor indexing in response to firing of the gun. Thus no external shell feeding drive means, such as electric or mechanical motors are required nor does operation of the apparatus slow operation of the gun. Included in the second stage actuation means is an actuation element connected to the second stage crankarm operative for causing compressing of springs in slide portions of the second stage feeding means in response to turning of such crankarm by the rotor shaft. Upon return of the actuation element, the slide springs connected to an advancing member of the slide portion cause advancing of shells in the supply means towards the rotor and transferring of an end shell into the adjacent rotor cavity.

To provide access to inner regions of the feeding apparatus, particularly the first stage feeding means, the rotor mounting means mounts the rotor to the gun in a manner enabling pivoting of the rotor away from the gun.

When the shell pick up position is laterally offset from the barrel bore axis of the gun, feed path control means are provided for controlling inward and forward movement of shells as the shells are fed from the pick up position into the firing chamber. Such feed path control means include configuring rotor surface regions defining the shell holding cavities and the shell retaining means to have shell engaging surface regions cooperatively configured for providing controlled and guided forward and inward shell feeding movement as a shell, picked up from the cavity indexed into the shell pick up position, is driven by the bolt toward and into the gun firing chamber. This feed path controlling is, particularly at high firing rates assures reliable feeding of shells, without damage thereto or jamming of the gun, into the firing chamber. Such feed path control is adapted for application to many types of guns. Accordingly, for a gun having shell supply means for containing shells to be fed into the gun and a bolt operative for axially reciprocating past a shell pick up position which is offset relative to a barrel bore axis of the gun and for picking up shells therefrom on forward bolt travel for loading into a gun firing chamber along a preestablished shell feed path, shell feeding apparatus comprises shell transferring means for transporting shells from the shell supply means to the shell pick up position, the transferring means including means defining at least one cavity configured for holding a shell transferred into the shell pick up position until the shell is picked up therefrom the bolt. The cavity defining means is configured to approximately match the external configuration of a free shell around a substantial portion of the shell perimeter, but is gradually longitudinally bowed inwardly toward the axis of the rotor along its rearward portion to facilitate a short steep shell feeding path while providing a guiding surface for smooth movement of the shell from the rotor cavity to the cannon firing chamber for at least substantial portions of the shell feed path. Included is a pair of shell feed lip members disposed adjacent the shell pick up position, the feed lip members being configured for preventing radial movement of a shell from the pick up position towards the barrel bore axis and being further configured for maintaining guiding engagement by portions thereof with a shell being picked up from the pick up position for at least substantial portions of the shell feed path.

The shell cavity defining means is configured to enable a rearward end of a shell picked up by the bolt from the pick up position to move away from the barrel bore axis to enable a steeper shell feed path.

Shell deflector means may be disposed forwardly of the pick up position for causing additional shell deflection towards the barrel bore axis, as may be desired for some gun configurations and/or firing rates.

As a result of configuration of the two stage shell feeding apparatus, a single shell (assuming a four cavity rotor) is rapidly rotated into the shell pick up position during an initial portion, for example, about 25 percent, of the cycling time after firing so as to assure presence of a shell for picking up by the bolt on counterrecoil. The remainder of the cycling time is allowed for the slower advancing of shells to load the rotor. The feed path control continues controlled loading of the shells into the gun firing chamber.

To prevent shell impact damage, which could cause impact firing or affect subsequent casing extraction and ejection after firing, shell accelerating means may be provided for causing, in response to forward bolt impact, forward acceleration of a shell in the pick-up position prior to engagement between the bolt and the shell. The shell accelerating means accelerates the shell in the pick-up position to approximately bolt forward velocity before the bolt engages the shell base for continued forward driving of the shell into the firing chamber.

Comprising the shell accelerating means are a shell accelerating element and means for pivotally mounting the element rearwardly of a shell positioned in the pick-up position and along the path of bolt travel. The element is formed having a forward, convex shell base engaging surface and a bolt engagement portion. Forward impact by the bolt against such bolt engagement portion causes the element to pivot forwardly so that the shell base engaging surface drives or pushes the shell forwardly ahead of the bolt. The pivotal mounting means also enable the element to pivot rearwardly in response to rearward bolt impact against the element, thereby permitting the bolt to travel rearwardly under the element, for example, during recoil after firing. Means are provided for causing the shell accelerating element to return to a central position in readiness for shell acceleration, after the element has been pivoted either forwardly or rearwardly by the bolt.

Preferably, the shell base engaging surface of the shell accelerating element is contoured to enable contact to be maintained between the surface and the shell base without bouncing as the accelerator element is pivoted forwardly by the bolt to cause shell acceleration. This reduces stresses and parts wear and assures uniform shell acceleration.

Although particularly useful in the two stage shell feeding apparatus because such apparatus is particularly adapted for high firing rates having associated therewith high bolt velocities, which could cause high shell impact stresses, the shell accelerating means is adaptable to other types of shell feeding apparatus. That is, configuration and operation of the shell accelerating apparatus is relatively independent upon configuration of the shell feeding apparatus.

A better understanding of the present invention may be had from a consideration of the following detailed description, taken in conjunction with the accompanying drawings in which:

FIG. 1 is a partially cut away, perspective drawing of a two stage shell feeding apparatus for an automatic gun, according to the present invention, showing first stage shell feeding means for rotatably transferring shells to a shell pick up or ram position of the gun and showing second stage shell feeding means for advancing shells from a shell supply means into the first stage shell feeding means;

FIG. 15(*a*) showing unlocking of the rotor from an anti-surge ratchet during early rotor shaft rotation; and, FIG. 15(*b*) showing unlocking of the rotor from a rotor ratchet during rotor shaft return rotation;

Figure 16:
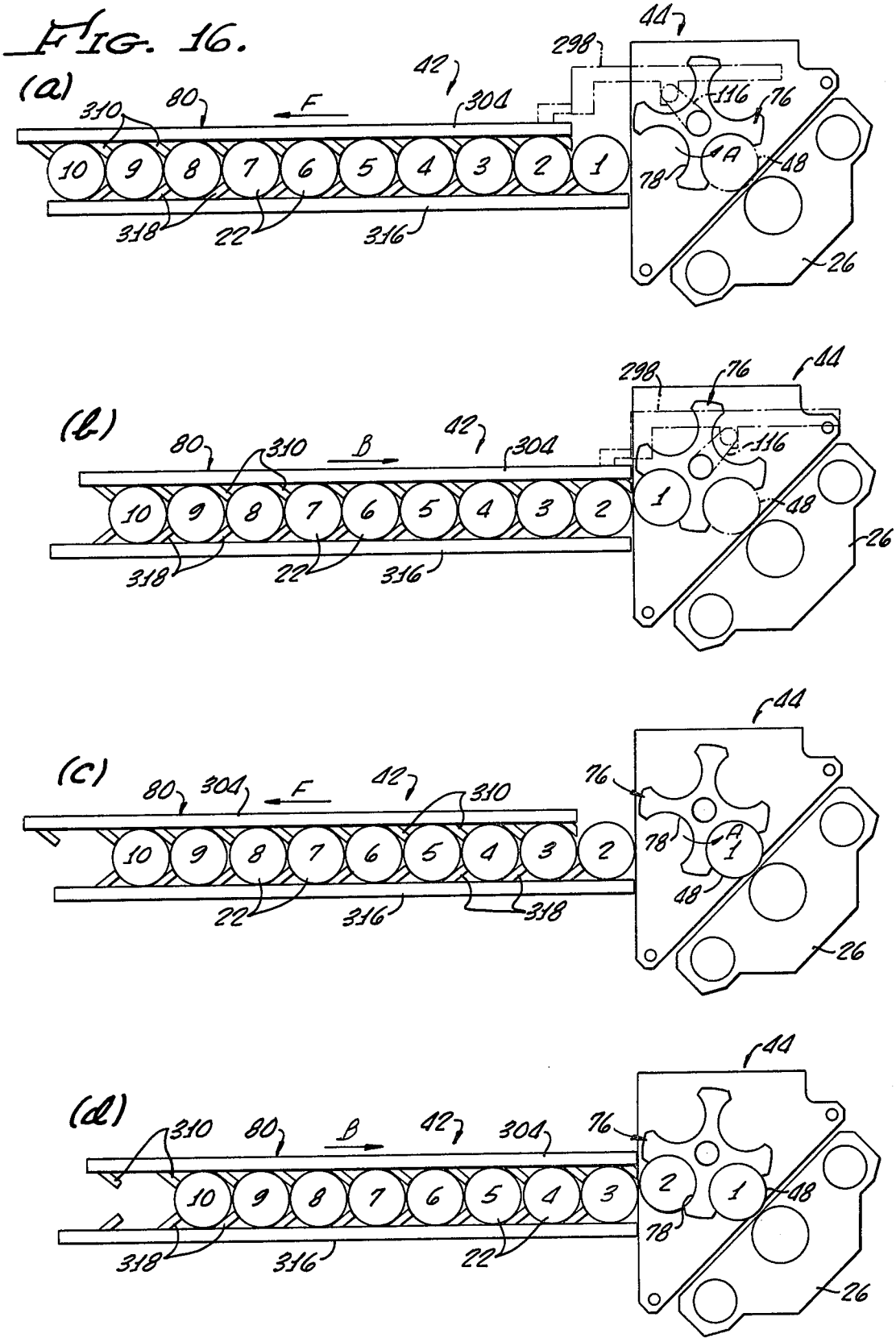
Figure 16:
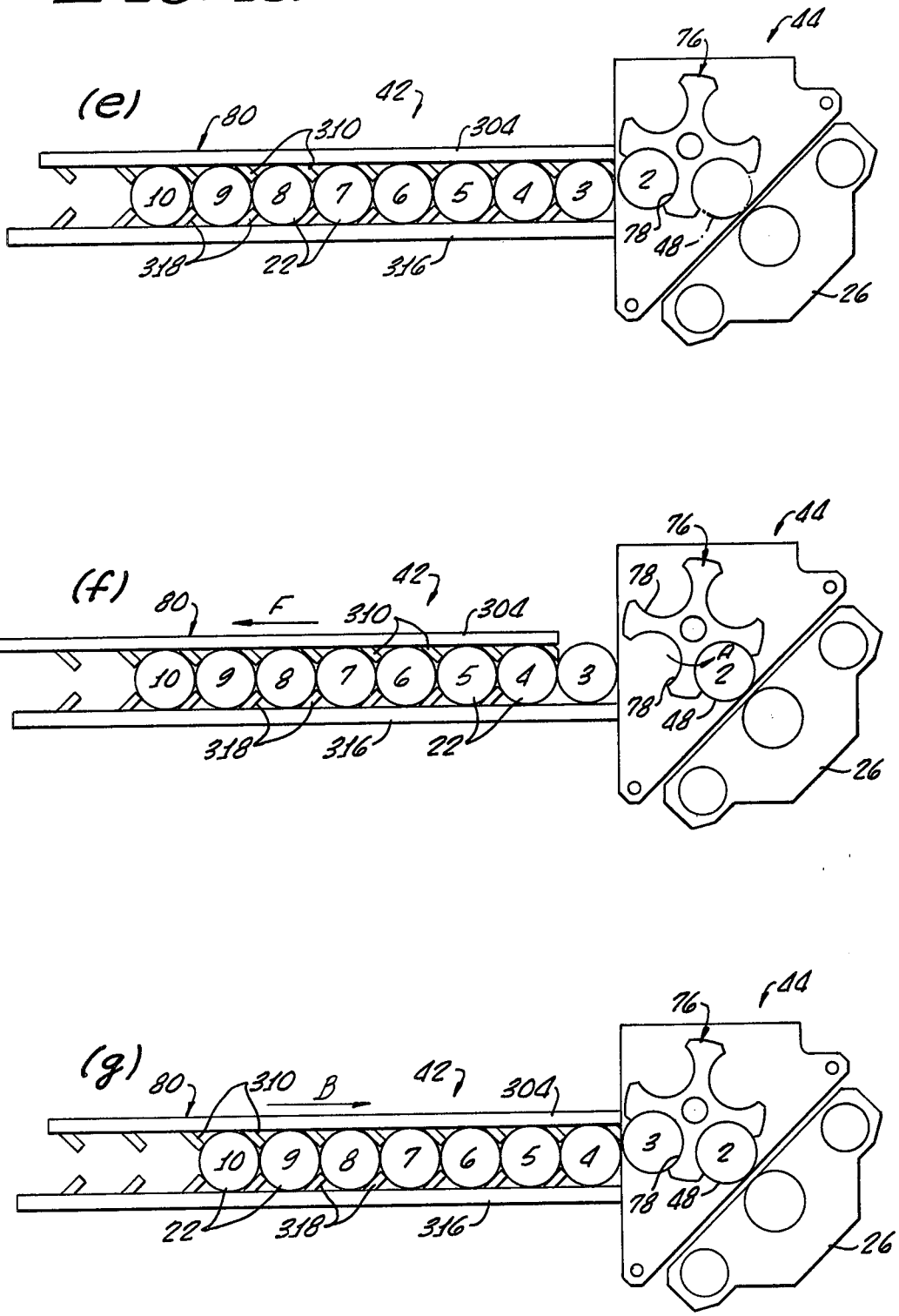
Figure 17:
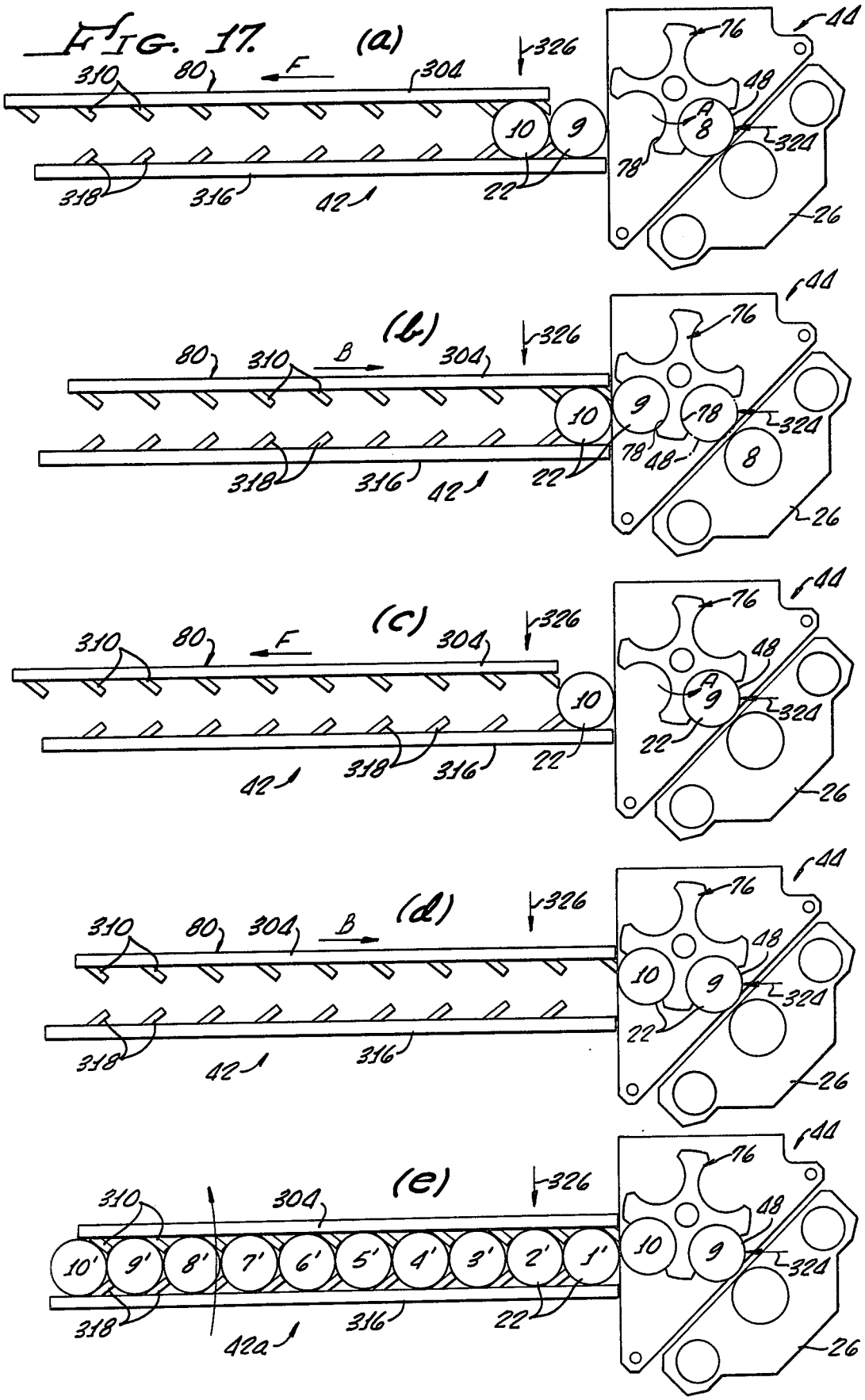
Figure 18:
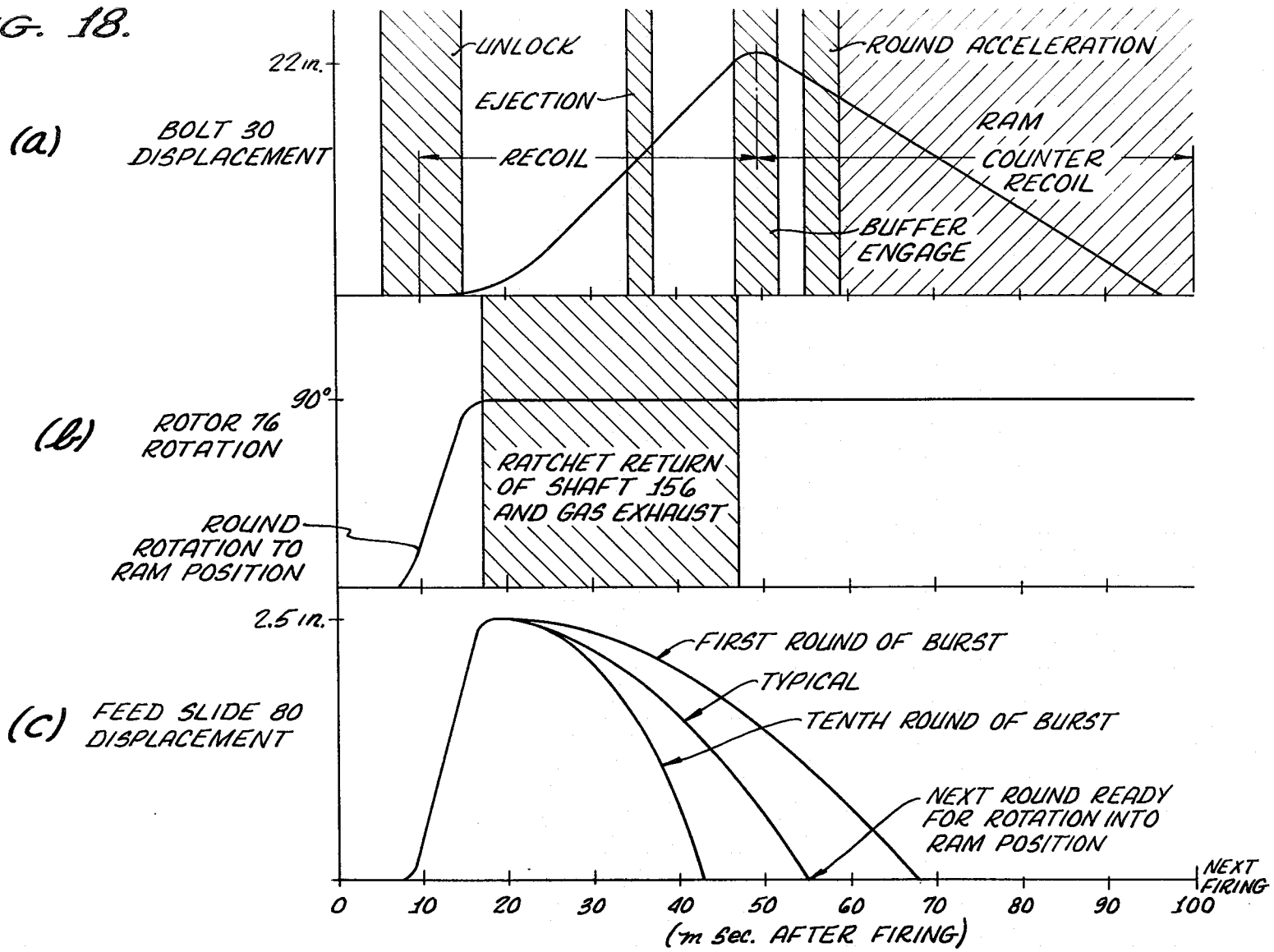

FIG. 16 is a time sequence series of pictorial diagrams depicting two stage shell feeding during gun charging and firing; FIG. 16(*a*) showing the rotor, at a prefiring time, in shell receiving relationship with a shell magazine segment, the empty rotor having been rotated 90° during a first part of a first charging operation; FIG. 16(*b*) showing second stage feeding of shell No. 1 into an empty rotor cavity during the last part of the first charging operation; FIG. 16(*c*) showing additional 90° rotor rotation during the first part of a second charging operation, thereby rotating shell No. 1 into the pick up position; FIG. 16(*d*) showing transfer of shell No. 2 into empty rotor cavity during the last part of the second charging operation, the gun being seared up ready for firing; FIG. 16(*e*) showing, after initiation of firing, shell No. 1 stripped from the rotor by the unseared bolt; FIG. 16(*f*) showing the rotor rotated 90° in response to firing of shell No. 1, thereby rotating shell No. 2 into the pick up position as the bolt starts recoiling; and, FIG. 16(*g*) showing the subsequent second stage advancing of shell No. 3 into the rotor;

FIG. 17 is a time sequence series of pictorial diagrams depicting an end-of-firing sequence; FIG. 17(*a*) showing shell No. 8 (of 10 shells) rotated by the rotor into the pick up position in response to firing shell No. 7; FIG. 17(*b*) showing shell No. 9 being subsequently transferred to an empty rotor cavity, with simultaneous advancing of shell No. 10 to the last slide position, with shell No. 8 having already been picked up by the bolt, a searing up signal being provided by the next-to-the-last slide position and the pick up position being simultaneously empty; FIG. 17(*c*) showing rotation of shell No. 9 into the pick up position, in response to firing of shell No. 8; FIG. 17(*d*) showing subsequent transfer of shell No. 10 into an empty rotor cavity, the bolt being researed; and, FIG. 17(*e*) showing a next magazine segment, holding shells 1'-10', indexed into shell transferring relationship with the rotor which still contains shells No. 9 and No. 10 from the first magazine segment; and FIG. 18 is a pictorial diagram showing an example of relative displacements, versus time after firing, of the cannon bolt, the rotor and the shell advancing slide during gun firing; FIG. 18(*a*) showing bolt displacement relative to the gun breech; FIG. 18(*b*) showing rotor angular displacement; and, FIG. 18(*c*) showing slide displacement.

Figure 1:
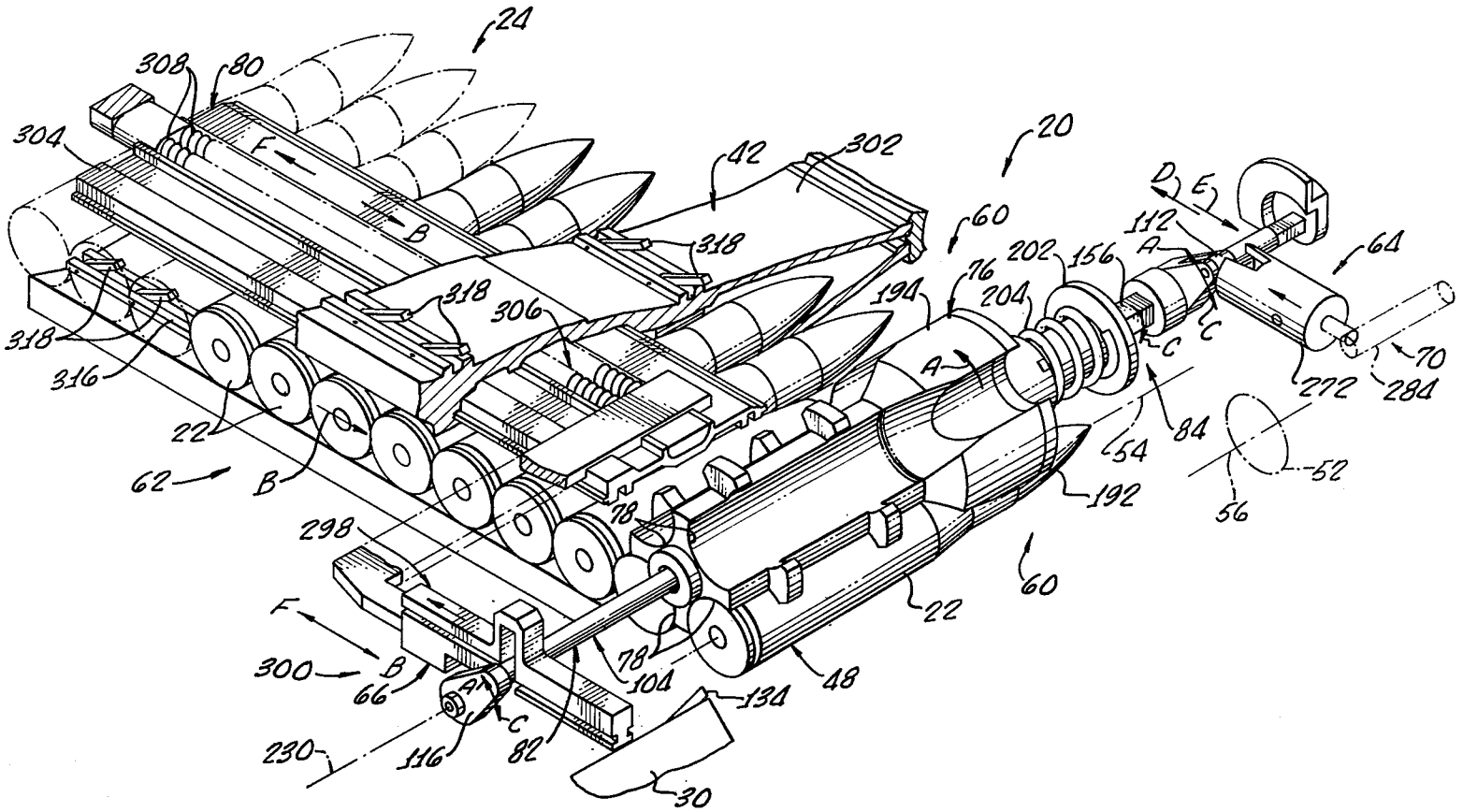
Figure 2:
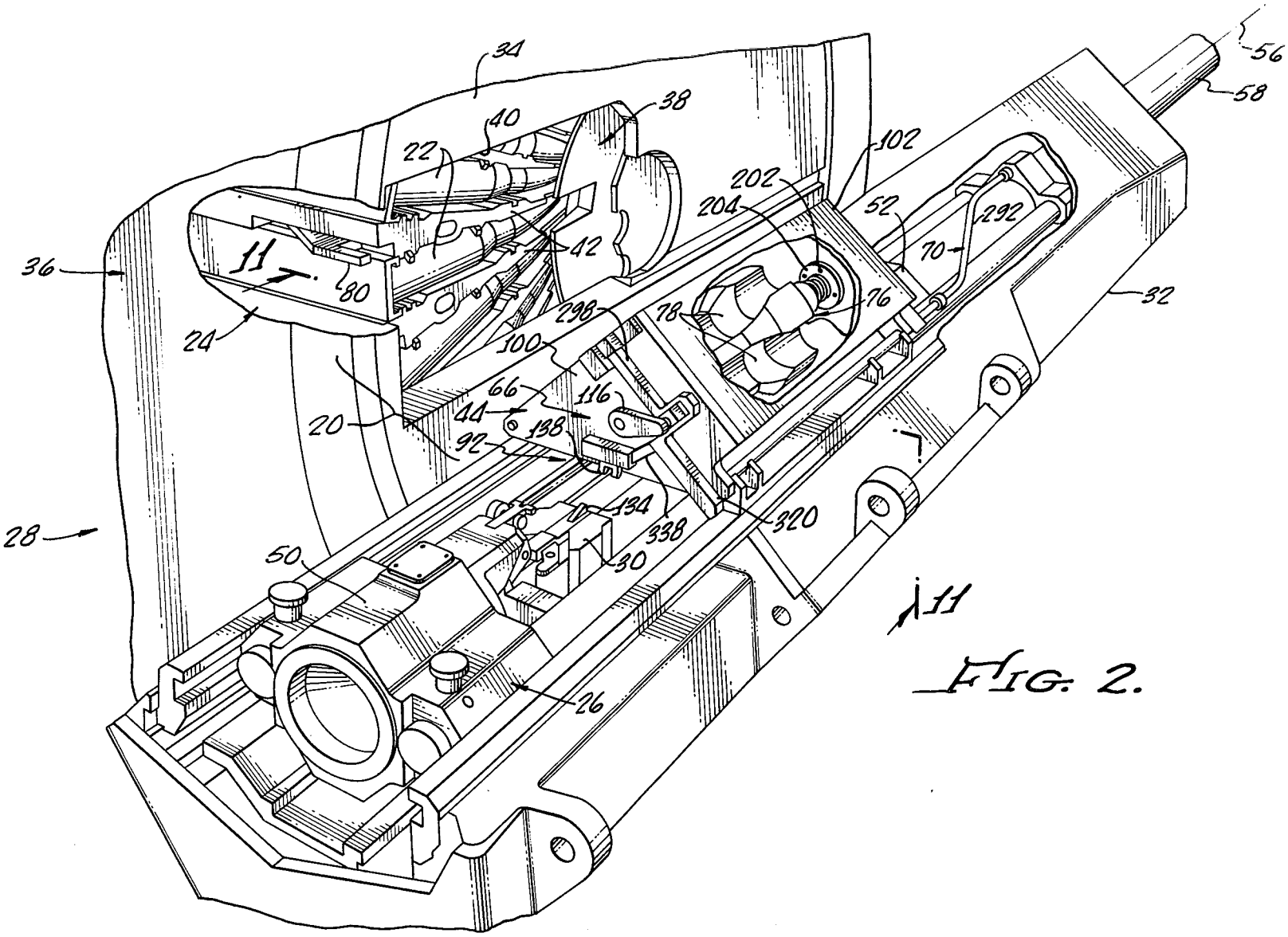
FIG. 2 is a partially cut away, perspective drawing showing the first stage feeding means and associated first and second actuating means mounted to a gun cradle which is in turn attached to a gun turret containing the shell supply means, the gun cradle being shown in an open configuration permitting access to the feeding apparatus.

In FIGS. 1 and 2 a two stage shell feeding apparatus 20, according to the present invention, is illustrated mounted for feeding shells 22 from a shell supply means 24 into an exemplary automatic cannon or gun 26 of a type adapted for use in an antiaircraft weapons system 28, (FIG. 2) only portions of the latter being shown. For illustrative purposes, the cannon 26 is depicted in FIG. 2 as an open receiver, gas operated type, an associated, axially reciprocating bolt or bolt assembly 30 being shown in a seared up position rearwardly of the feeding apparatus 20.

By way of example, the cannon 26 is shown received into a gun cradle 32 pivotally mounted, for opening and closing, to a side plate 34 which is, in turn, rotatably connected, for gun elevational movement, to a weapons system turret or cupola 36. The cradle 32 is shown in a fully open, nonfiring, position on the turret 36, as is used for access to the shell feeding apparatus 20 and other portions of the cannon 26.

As shown for illustrative purposes, the shell supply means 24 comprises a rotating drum magazine 38 mounted inside the turret 36, the shells 22 being fed from the magazine 38 to the cannon 26 through an aperture 40 in the side plate 34. The exemplary magazine 38 is divided into a relatively large number of pie-shaped drum segments 42, each holding, for example, 10, clip-mounted shells 22. However, as will be apparent from the ensuing description, the shell feeding apparatus 20 is adapted for use with virtually any type of shell supply means, including hopper and belt types.

Furthermore, although the shell feeding apparatus 20 is shown configured such that a major portion 44 thereof is mounted directly onto the cradle 32, directly above the cannon 26, as is preferred for the particular type cannon 26 and weapons system 28 shown, it is to be appreciated that the shell feeding apparatus is readily adaptable for use with most types of automatic cannon (or guns) which operate on an axially reciprocating bolt principle. Thus, for the exemplary cannon 26, the bolt 30 is operative for stripping one of the shells 22 indexed into a shell pick up or ram position 48 (shown in FIG. 13 in phantom lines) in the shell feeding portion 44 on a forward or counterrecoil stroke either from an initial rearward seared up position or in counterrecoil from a rear, recoil buffer 50 and towards a cannon breech or firing chamber 52 (shown in FIG. 1 in phantom line). Thus, the bolt 30 passes the loaded pick up position 48 both during recoil from the breech 52 on firing and on counterrecoil from the buffer 50 thereafter, the longitudinal axis 54 of the pick up position being offset from (above in FIGS. 1 and 2) the bore axis 56 of an associated cannon barrel 58.

As seen in FIG. 1, the shell feeding apparatus 20 which, in response to firing of the cannon 26, feeds the shells 22 from the shell supply means 24 into the cannon in two steps, comprises generally rapid acting, rotary first stage feeding means 60 and typically slower acting, linear second stage feeding means 62. Interconnected first and second stage actuating mean 64 and 66, respectively, are provided for operating the first and second stage feeding means 60 and 62, as described below. Although other types of driving may alternatively be employed to advantage, the first and second actuating means 64 and 66 are shown configured for operation by high pressure barrel gases, which are fed to the first actuating means from the cannon barrel 58 (FIG. 2) by gas supply means 70.

Included in the first stage feeding means 60 is a shell rotor 76 formed having a plurality of longitudinal, external shell holding cavities 78 which are equally spaced around the rotor periphery. For the rotor 76 shown, four cavities 78, spaced at 90° intervals, are used. The second stage feeding means 62 includes a linear shell advancing slide 80, made sufficiently long to span all the shells 22, for example, ten, contained in any of the drum segments 42, one such slide being provided for each of the segments and rotating therewith.

Assuming precharging of the rotor 76, upon firing of the cannon 26, the first actuating means 64 immediately rotates the rotor 76, in the direction of Arrow "A" (FIG. 1), a partial turn (90° for the four cavity rotor shown) to index a shell containing cavity 78 into the shell pick up position 48. This rotor turning and shell indexing is preferably timed to occur, as described below, sufficiently in advance of the bolt 30 impacting the buffer 50 and rebounding forwardly in counterrecoil to assure stable positioning of a shell in the pick up position before pick up.

After such rotor indexing, and sometime during the rest of the bolt cycle time, the slide 80, actuated by the second actuating means 66, moves all the shells 22 remaining in the associated segment 42 one shell position (direction of Arrow "B") to advance an end one of the shells into an adjacent empty one of the rotor cavities 78.

When the segment 42 is fully loaded or contains a number of shells 22, the second stage feeding operation necessarily is slower than the first stage rotation of only a single shell through 90°. Thus, the rapid first stage feeding assures a shell is stabilized in the shell pick up position before the time of pick up and enables a relatively slower second stage shell transfer to the rotor 76. As an example, and as more fully discussed below, the first stage feeding typically occurs within the first 20–25 percent of the firing cycle time, leaving the remaining 75–80 percent of cycling time for the slower second stage feeding.

This two stage feeding is important because of the difficulty of advancing an entire segment of shells 22 in a single step fast enough to assure a shell is in position for picking up on bolt counterrecoil. Thus, at least for fully or nearly fully loaded segments 42, single step feeding tends to be unreliable at even moderate firing rates.

Figure 3:
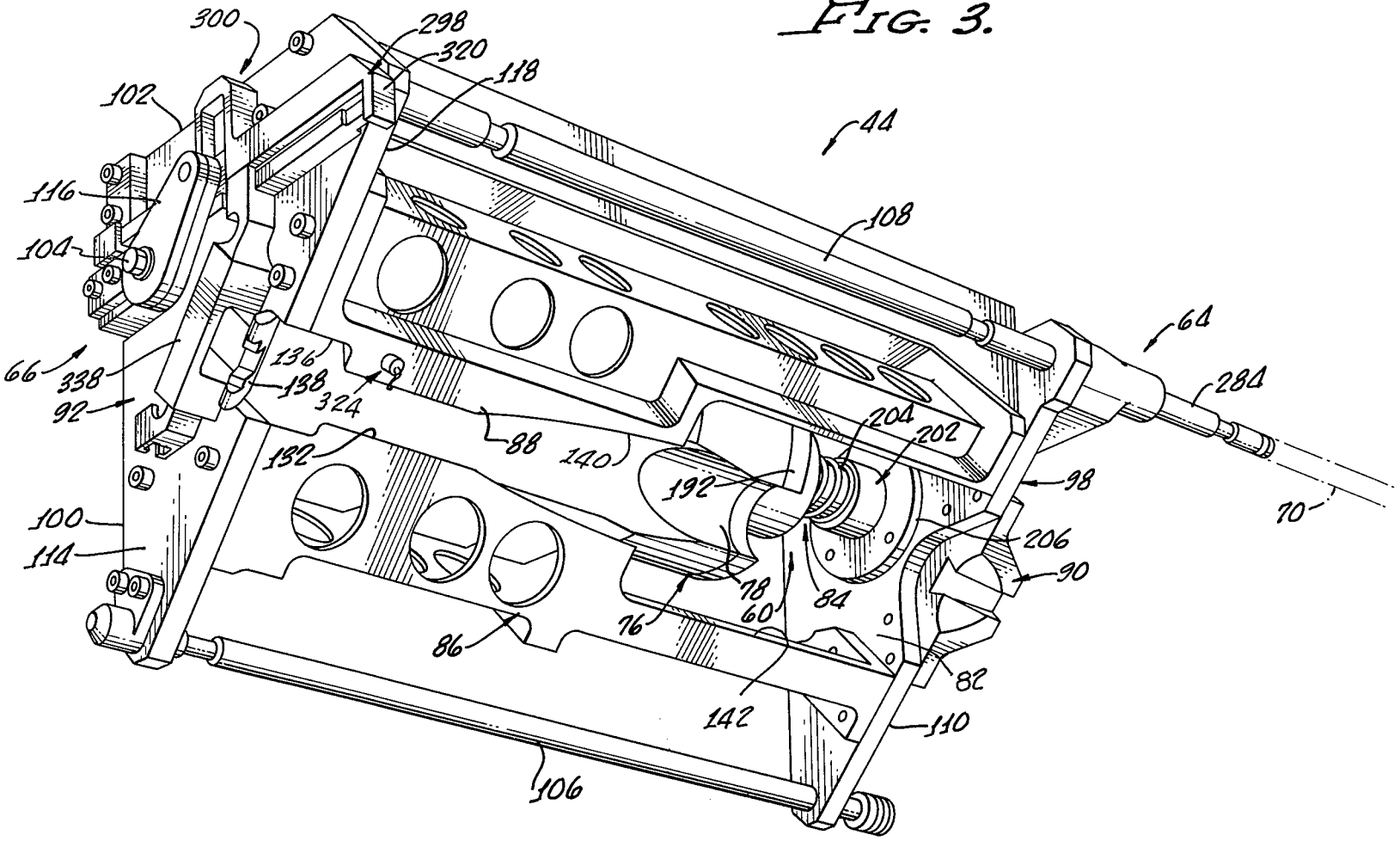
FIG. 3 is a perspective drawing, looking forwardly from an under side of the cradle mounted portion of the shell feeding apparatus, showing shell rotor and feed lip portions of the first stage feeding means and showing second actuating means associated with the second stage feeding means.
Figure 4:
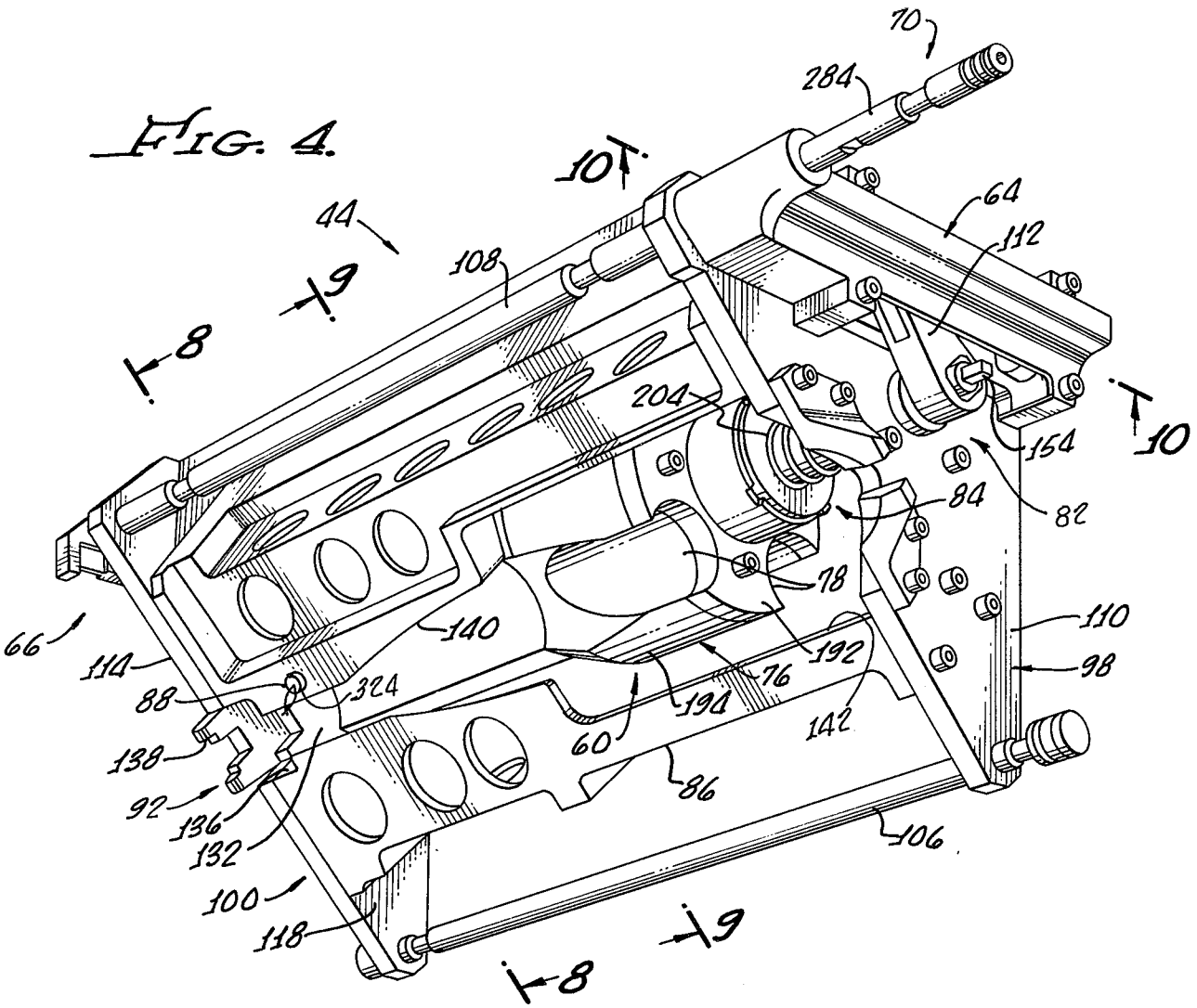
FIG. 4 is a perspective drawing, similar to FIG. 3 but looking rearwardly from an under side of the cradle mounted shell feeding portion, showing gas operated first actuating means associated with the first stage feeding means.

More specifically, as seen in FIGS. 3 and 4, the shell feeding portion 44, which is mounted on the cradle 32, includes the first stage feeding means 60, the first and second actuating means 64 and 66, rotor mounting means 82, rotor racheting and anti-surge means 84, first and second feed lip members 86 and 88, respectively, shell deflector means 90 and shell accelerator means 92.

Comprising the rotor mounting means 82 are rigid, spaced apart, front and rear end plates 98 and 100, respectively, which are generally triangular in shape. Included also are a rigid rectangular side plate 102, which interconnects the front and rear end plates 98 and 100, and a shaft assembly 104 mounting the rotor 76 and the associated ratchet and anti-surge means 84 between such plates. Included also are first and second, laterally spaced apart pivot rods 106 and 108, respectively, which extend between the front and rear plates 98 and 100, at opposite lower corner regions thereof, the rods functioning to pivotally and releasably attach the rotor mounting means 82 to the gun cradle 32. In addition, as further described below, portions of the first rod 108 also function as part of the gas supply means 70.

Rigid longitudinal separation of the front and rear plates 98 and 100, through which opposite end regions of the rotor shaft asssembly 104 are rotatably mounted, is by the side plate 102, the feed lip members 86 and 88 and the rods 106 and 108.

Figure 6:
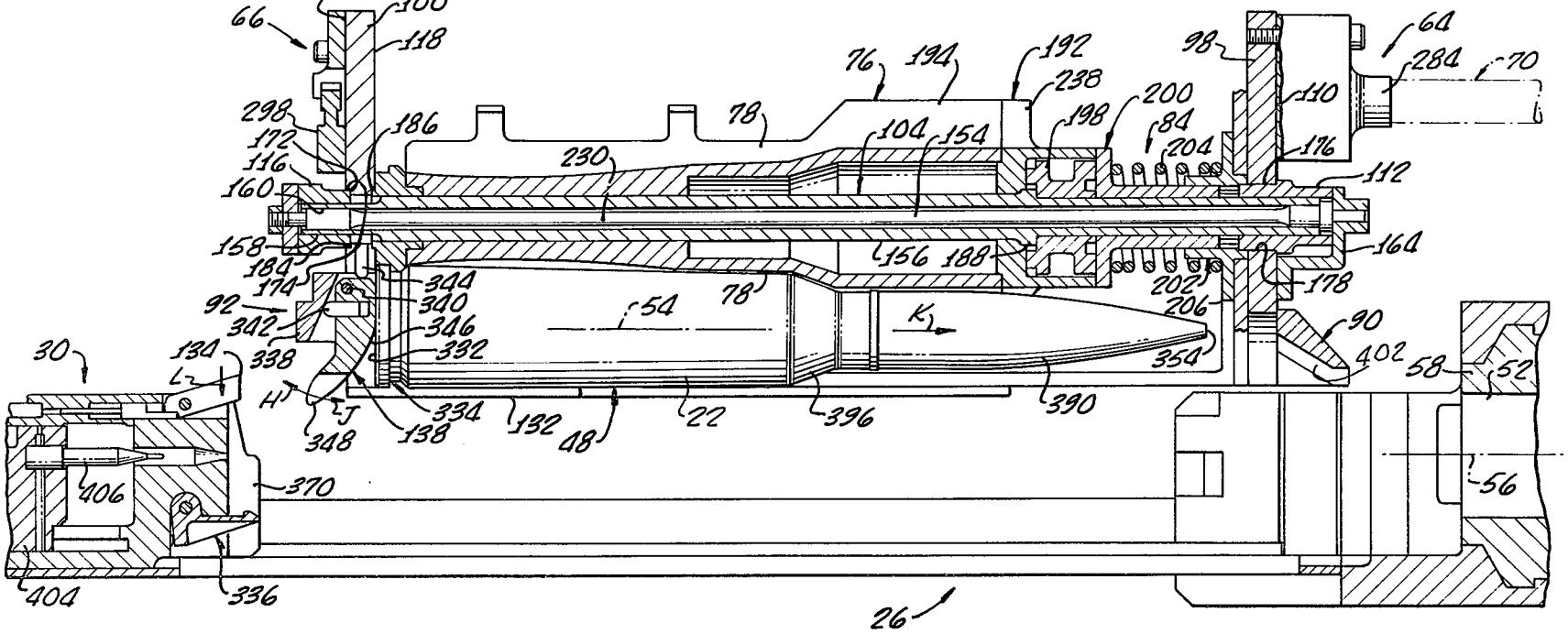
FIG. 6 is longitudinal cross sectional view, taken along line 6—6 of FIG. 2, showing features of the shell rotor and mounting means therefor, and shell accelerator means mounted for engaging a base region of the shell.
Figure 7:
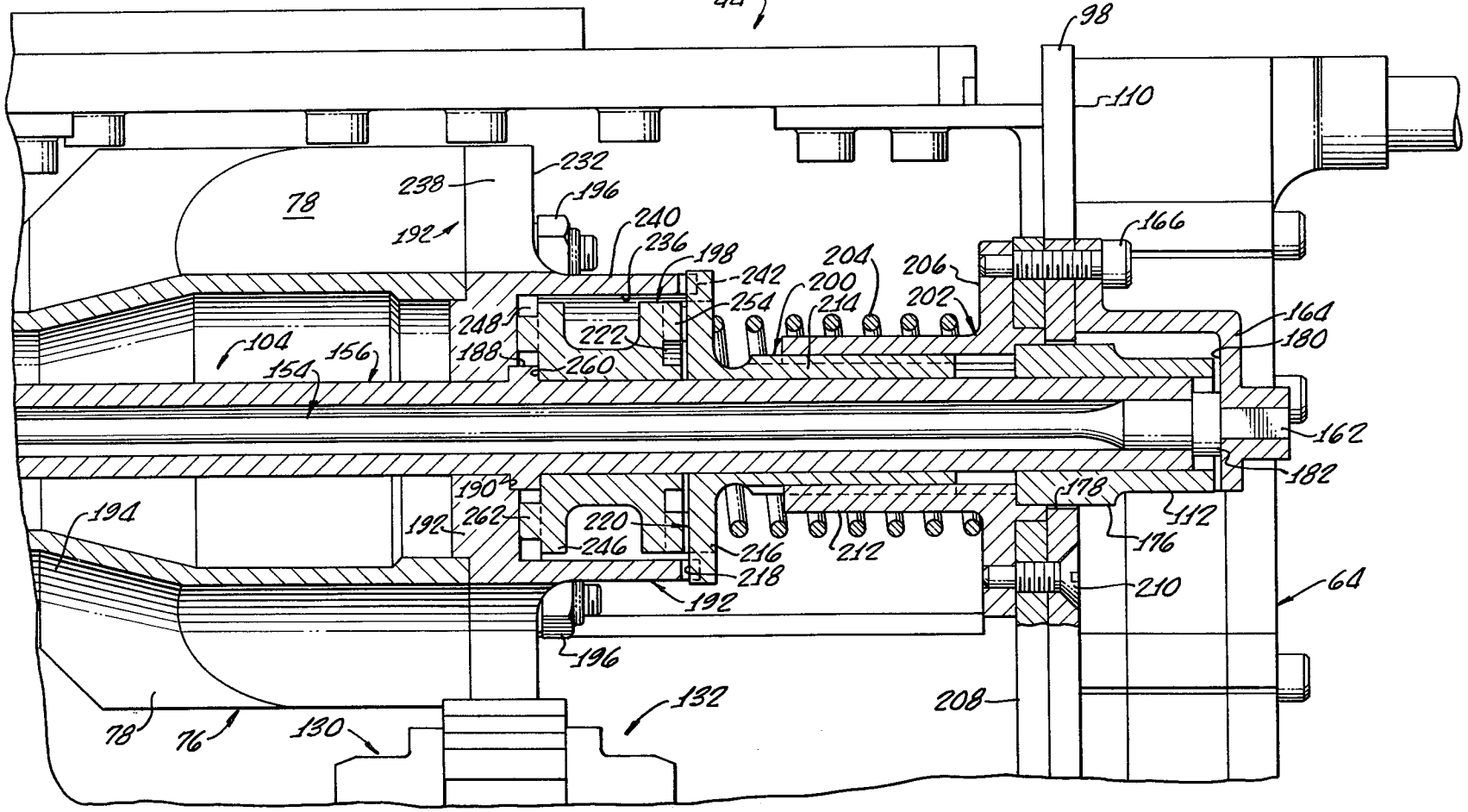
FIG. 7 is a partial longitudinal cross sectional view, taken in the plane of FIG. 6, showing, in enlarged form, features of the rotor ratcheting and anti-surge means, with the rotor locked against rotation.

As also seen in FIGS. 6 and 7, attached to a forward surface 110 of the front plate 98, relatively adjacent to the rotor shaft assembly 104, are the first actuating means 64, a crankarm 112 of which is fixed to a forward end of such shaft assembly. Also mounted to the forward surface 110, in a position to engage the shell 22 as it is stripped fowardly from the shell pick up position 48, are the shell deflector means 90.

In a similar manner, the second actuating means 66 are attached to a rearward surface 114 of the rear plate 100 relatively adjacent to the rotor shaft assembly 104, a crankarm 116 of the second actuating means being fixed to a rear end of the shaft assembly. Also attached to the rear plate surface 114, so as to be rearwardly adjacent to whichever shell 22 is in the shell pick up position 48, is the shell accelerator means 92.

Mounted to a forward surface 118 (FIG. 8) of the rear plate 100 are first and second, spring loaded shell positioning and retaining detent means 120 and 122, respectively. Mounted to an inner surface 128 of the side plate 102, for engagement with peripheral regions of the rotor 76 are ratchet-type spring loaded, rotor anti-backup means 130 (FIG. 7), which prevent reverse direction rotor rotation, as described below.

Also as described below, the feed lip members 86 and 88, together with the shell deflector means 90 and whichever one of the rotor cavities 78 is indexed into the pick up position 48, cooperatively provide feed path control for shells stripped from the rotor 76 by the bolt 30.

Because the feed lip members 86 and 88 are positioned between the rotor 76 and the bolt path, opposing edge regions of the members, adjacent to the pick up position 48, are laterally separated a distance sufficient to enable shell stripping engagement between the bolt 30 and whichever shell 22 is indexed into the shell pick up position. Closest opposing edge regions of the feed lip members 86 and 88 are thus separated by a gap 132 which is everywhere at least sufficiently wide to permit longitudinal passage of a shell rammer 143 which is mounted to forward upper regions of the bolt 30.

However, in a rearward region 136, edges of the gap 132 are stepped apart to a width greater than that of narrowest gap regions immediately forward thereof to provide clearance for an accelerator member 138 of the shell accelerator means 92. In a mid-region 140 of the gap 132, edges of the gap diverge in a forward direction to enable guided movement of shells stripped from the pick up position 48 inwardly and forwardly towards the firing chamber 52; while in a forwardmost gap region 142, edges of the gap are stepped farther apart to enable shell passage therethrough.

The first feed lip member 86 is also configured for confining in the rotor 76, the shells 22 being transferred by the rotor from the shell supply means 24 to the shell pick up position 48 during rotor rotation. Accordingly, an arcuate, rotor facing surface 148 (FIG. 8) of the first feed lip member 86 is formed having substantially the same radius as outer surfaces of the rotor 76, the rotor facing surface being spaced closely adjacent to the rotor in the 90° quadrant of rotor shell transfer.

Figure 8:
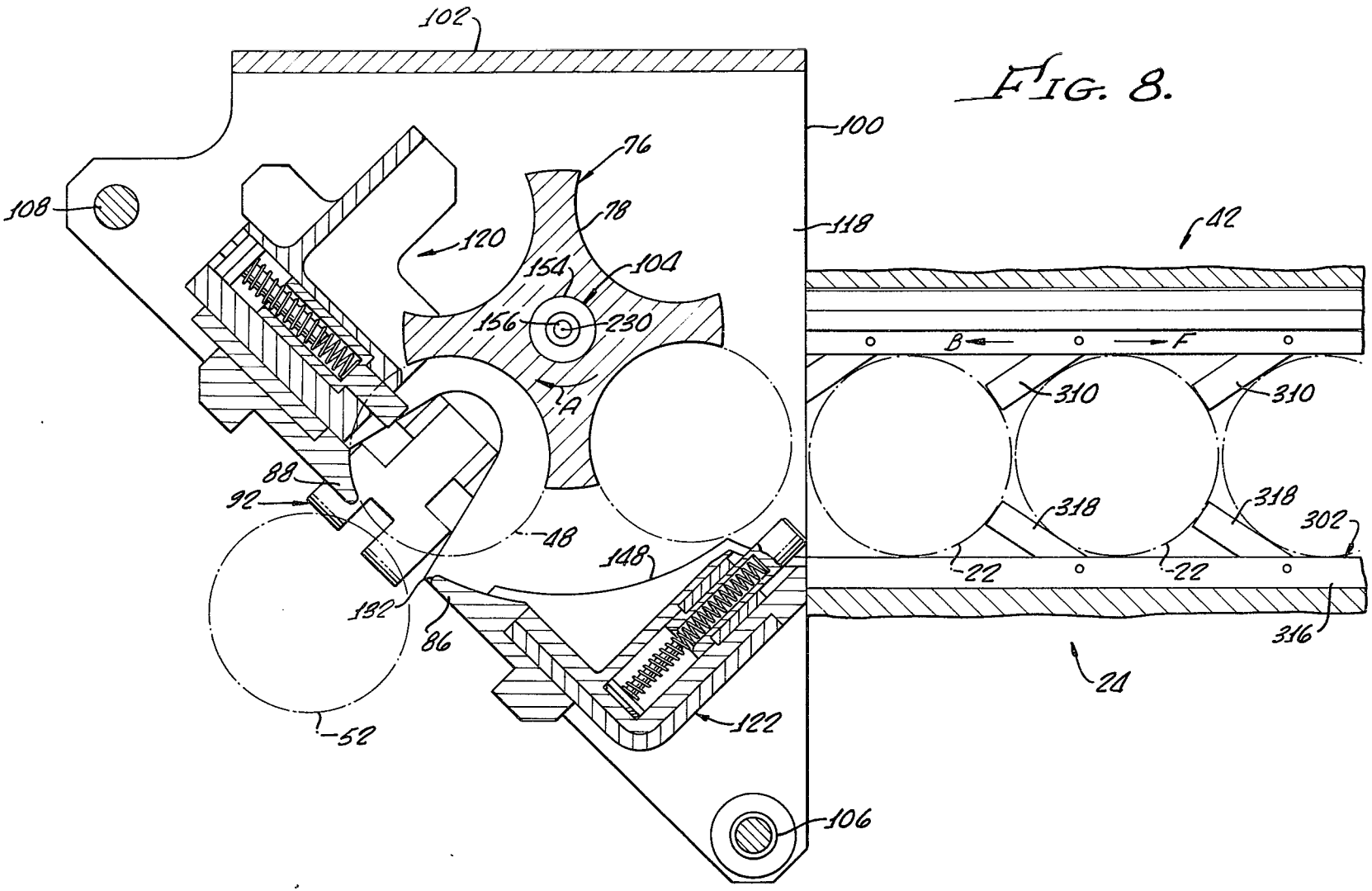
FIG. 8 is a transverse cross sectional view of the cradle mounted portion of the shell feeding apparatus, taken along line 8—8 of FIG. 4, showing rotor and feed lip configuration in a rearward region and showing associated portions of the shell supply means in phantom lines.
Figure 9:
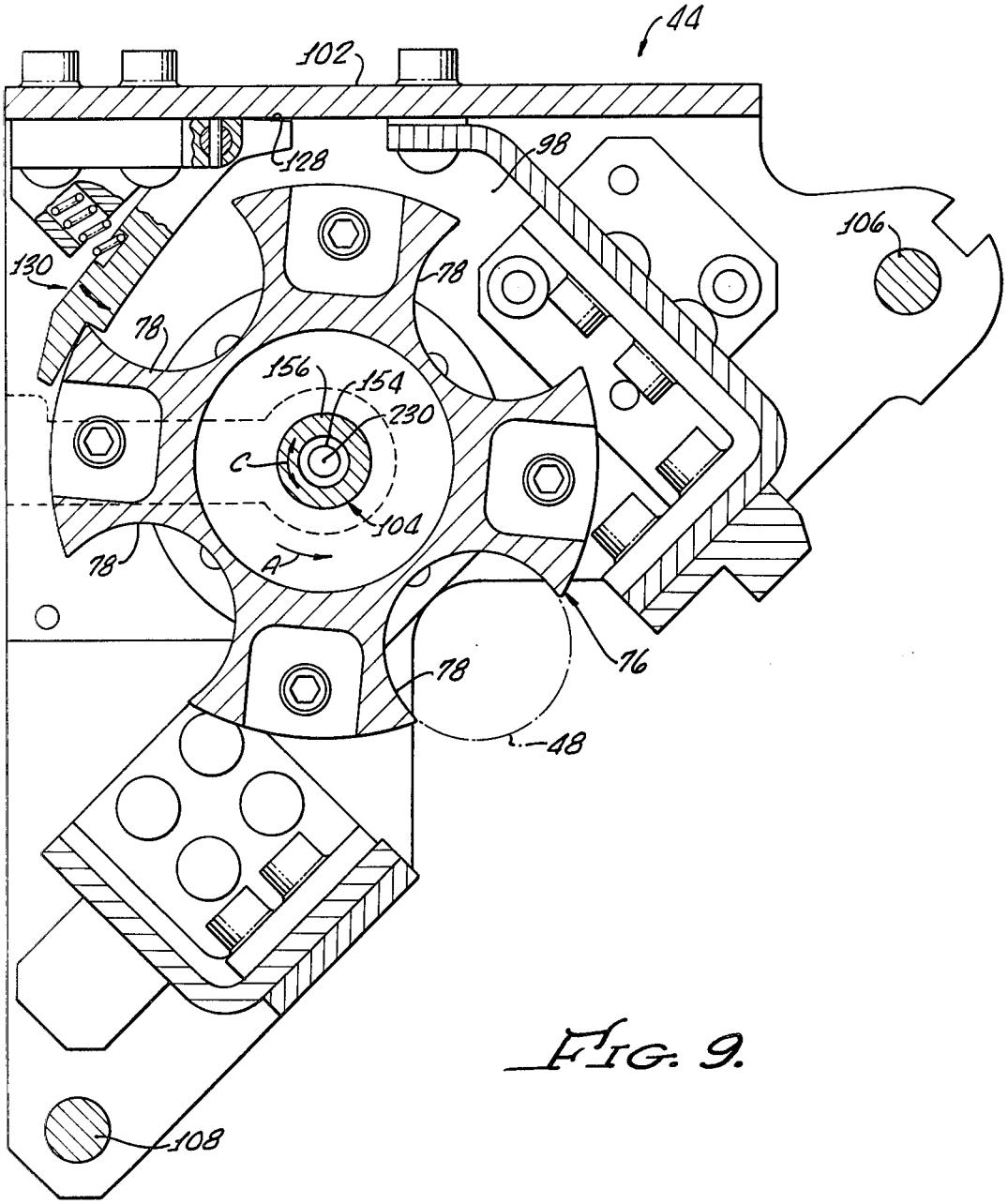
FIG. 9 is a transverse cross sectional view of the cradle mounted portion of the shell feeding apparatus, taken along line 9—9 of FIG. 4, showing rotor and feed lip configuration in a forward region.

To index the rotor held shells 22 in 90° rotational steps, between the shell supply means 24 and the shell pick up position 48, incremental, unidirectional rotor rotation (in the direction of Arrow "A". FIGS. 1, 8 and 9) is required. However, due to piston operation, through the shaft mounted crankarm 112, of the rotor shaft assembly 104 on which the rotor 76 is mounted, shaft rotation first in the direction of rotor advancement and then return rotation to the initial shaft position is necessary. This interrupted, unidirectional 90° step indexing of the rotor 76 and reciprocating rotational movement of the shaft assembly 104 is enabled by the rotor ratchet and anti-surge means 84, portions of which couple the rotor to the shaft assembly, and by the rotor anti-backup means 130 which prevents rotor counterrotation. Return rotation, that is, counterrotation, of the shaft assembly 104 is caused by torsional spring properties thereof.

This torsional spring action is enabled by constructing the shaft assembly 104 to have an elongated torsion bar 154 disposed within a rigid tubular main shaft 156

(FIGS. 6 and 7). Only at rearward ends, corresponding to shaft connection to the crankarm 116, are the torsion bar 154 and the main shaft 156 connected together. This connection may, as shown, be by disposing a square cross sectional region 158 of the torsion bar 154 within a corresponding square cross section aperture 160 at the rearward end of the main shaft 156.

At a forward end, however, the torsion bar 154 is nonrotatably fixed relative to the front plate 98. A square in cross section, torsion bar forward end region 162 is thus nonrotatably received into a mounting bracket 164 which is, in turn, fastened by several bolts 166 to the front plate. Preferably, the bracket 164 is configured, and the bolts 166 are spaced, to enable incremental, rotational positioning of the bracket relative to the plate 98, to thereby enable preloading of the torsion bar 154.

Although rearward ends of the torsion bar 154 and the main shaft 156 are fixed together, limited relative rotational movement between the bar and main shaft is permitted in other regions. Since the crankarm 112 is fixed only to the main shaft 156, for example, by mating of square cross section crankarm and shaft regions, rotational movement of the crankarm 112 by the first actuating means 64, and hence rotational movement of the main shaft, causes twisting of the torsion bar 154. Such torsion bar twisting provides the spring force necessary for returning the main shaft 156, and hence the crankarm 112, to their initial, unrotated positions. Because of torsional rigidity of the main shaft 156, any rotational movement of the crankarm 112 of the first actuating means 66 causes simultaneous, equal rotation of the crankarm 116 which is associated with the second actuating means 68.

Rotational mounting of the main shaft 156, and hence the rotor 76, is provided by a generally cylindrical portion 172 of the crankarm 116, which is received into a circular aperture 174 in the rear plate 100, and by a generally cylindrical portion 176 of the crankarm 112, which is received in a circular aperture 178 in the front plate 98 (FIGS. 6 and 7). Confinement of the shaft assembly 104 against forward axial movement is by a rearward surface 180 of the mounting bracket 164 bearing against a torsion bar annular shoulder 182 and by a shoulder 184 formed on the crankarm 116 which bears against the rearward surface 114 of the rear plate 100 (FIG. 6). Axially rearward movement of the shaft assembly 104 is prevented by a rear rotor face 186 which bears against the forward surface 118 of the rear plate 100. The rotor is otherwise confined on the shaft assembly 104 by an annular shoulder 188 formed around the periphery of the main shaft 156, which bears against a corresponding forward rotor face region 190 (FIG. 7).

Configuration of the ratcheting and anti-surge means 84 enables the rotor 76, after rotational indexing through 90°, to remain indexed as the rotor shaft 104 is rerotated to its initial position, and enables releasable locking of the rotor against rotation which might otherwise occur when shells are advanced by the second stage feeding portion 62 from the supply means 24 into the rotor. Comprising the ratcheting and anti-surge means 84 are a rotor hub 192 which forms a part of the rotor 76 and which is connected to a main rotor portion 194 by a plurality of bolts 196; a rotor ratchet 198; an anti-surge ratchet 200; a bearing member 202 and a compression-type ratchet spring 204.

Figure 5:
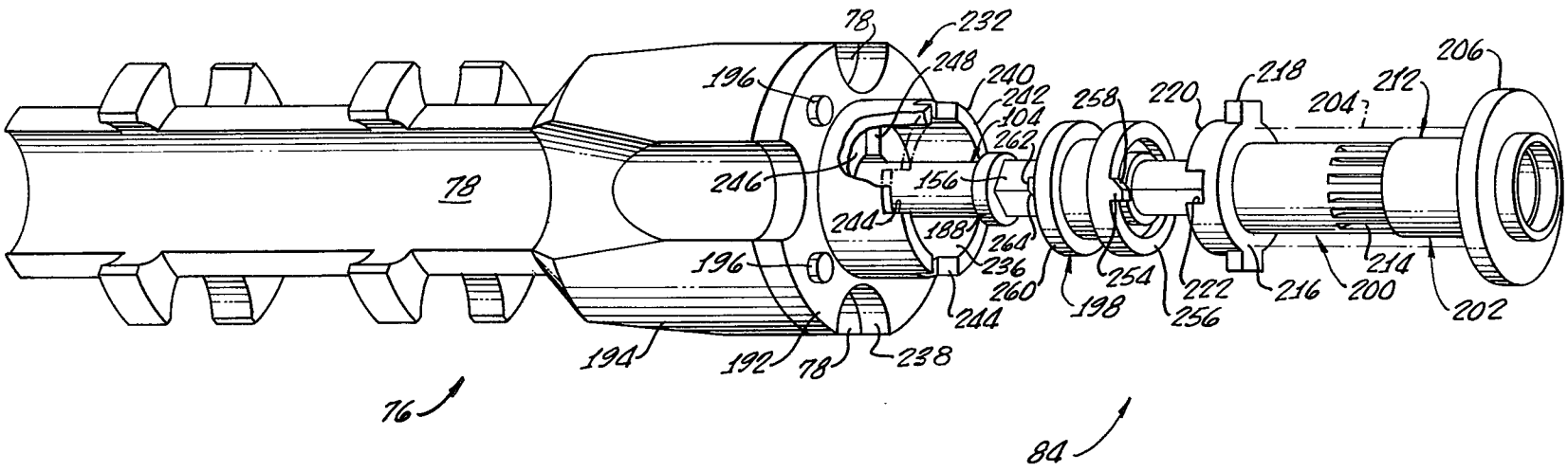
FIG. 5 is a partially cut away, exploded drawing of rotor portions associated with the first stage feeding means, showing configuration of rotor shell transferring cavities and ratcheting and anti-surge means for controlling rotor rotation.

As seen in FIGS. 5–7, the bearing member 202, which is generally tubular in configuration, is mounted over the main shaft 156 to extend partially forwardly through the front plate 98 to form a bearing for rotation of the crankarm 112. A sidewardly projecting annular flange 206 at the forward end of the bearing member 202 is bolted to a front plate rearward face 208 by the bolts 166 which attach the bracket 164 to the front plate 98. Several additional bolts 210 may also be used to attach the flange 206 to the front plate 98. A rearwardly extending, tubular portion 212 of the bearing member 202 is internally splined for receiving portions of the anti-surge ratchet 200.

Forming the anti-surge ratchet 200, which is mounted over the shaft assembly 104 rearwardly of the bearing member 202, is an externally splined, forwardly extending portion 214, which is slidingly disposed within the bearing portion 212, and a rear, sidewardly projecting flange 216. Disposed around the overlapping tubular portions 212 and 214, respectively, of the bearing member 202 and the anti-surge ratchet 200, the spring 204 biases or urges the anti-surge ratchet rearwardly towards the rotor hub 192.

Since the bearing member 202 is fixed to the front plate 98 and because of the splined interconnection, the anti-surge ratchet 200 is permitted only axially sliding movement. Both the bearing member 202 and the anti-surge ratchet 200 are internally configured to permit rotation of the main shaft 156 therewithin.

Spaced 180° apart on the periphery of the anti-surge ratchet flange 216 are two generally rectangular, radially projecting ears or teeth 218 (FIGS. 1, 5 and 7) for engaging the rotor hub 192, as described below. Sides of the teeth 218 rearwardly converge at a small angle of, for example, about 10°. Formed orthogonally to a line through the teeth 218 and forwardly into a flat transverse rearward surface 220 of the flange 216, is a narrow, transverse ratchet recess 222. Such recess 222 extends through a rotational axis 230 of the anti-surge ratchet 200, and hence of the rotor 76 and the rotor shaft assembly 104. Side edges of the recess 222 are chamfered to enable smooth ratcheting disconnection.

Formed at the rear end of the rotor hub 192 is a rigid, sidewardly projecting flange 232 through which the rotor attaching bolts 196 are installed. Peripheral recesses 238 in the flange 232 continue, and thus form forward end regions of, the rotor cavities 78. Extending forwardly from the flange 232 and defining a forward hub recess 236, is a tubular hub portion 240. Formed into a forward edge 242 of such portion 240 at 90° spacing are four rectangular recesses 244, with chamfered sides, configured for locking engagement by the anti-surge ratchet teeth 218. When so engaged, the rotor hub 192, and hence the entire rotor 76, is locked to the front plate 98 against rotational movement, through the anti-surge ratchet 200, to prevent any rotational driving of the rotor 76 as shells are advanced thereinto from the supply means 24.

Formed rearwardly into a hub recess bottom or forward face 246, at 90 degree spacings, are four generally rectangular, radial recesses 248 with chamfered sides, for ratcheting engagement with the ratchet 198.

Disposed within the hub recess 236, between the rotor hub face 246 and the anti-surge ratchet flange 216, the ratchet 198 is nonrotatably, but axially slidably, mounted over the shaft assembly 104. To provide for rotation/ratcheting of the rotor and the anti-surge ratchet 200, the generally cylindrical ratchet 198 is formed having ratchet teeth on both axial ends.

Two diametrically opposed, forward teeth 254 formed on the ratchet 198 project forwardly from a ratchet forward face 256 for driving engagement with the anti-surge ratchet recess 222 (FIG. 7). Corresponding single side surfaces 258 of the teeth 254 are beveled at an angle of about 45° in a direction enabling the teeth 254 to slide or ramp out of the anti-surge ratchet recess 222 in response to rotation of the main shaft 156, and hence of the ratchet 198, in the shell transferring direction of Arrow "A".

Formed on the ratchet 198 to project rearwardly from a ratchet rearward face 260, are four equally spaced, rearward teeth 262 configured for driving engagement with the rotor hub recesses 248. Corresponding side surfaces 264 of all the rearward teeth 262 are beveled oppositely to the surfaces 258 of the forward teeth 254 at angles of about 45°, and thus in a direction enabling the rearward teeth to ramp out of the rotor hub recesses 248 when the main shaft 156, and hence the rotor 198, is return rotated (direction of Arrow "C", FIGS. 1 and 9) to enable rotatable decoupling of the rotor 76 from the shaft.

Relative axial lengths of the rotor 198 and the rotor hub portion 240 are such that when the ratchet forward teeth 254 are fully received into the corresponding anti-surge ratchet recess 222 and the ratchet rearward teeth 262 are fully received into the rotor hub recesses 248, the anti-surge ratchet teeth 218 are received, in rotor-locking relationship, within a pair of the rotor hub forward edge recesses 244.

In such double tooth-recess engagement condition, the rotor 76 is non-rotatably locked, through the rotor hub 192, the anti-surge ratchet 200 and the bearing 202, to the front plate 98. Hence, shell transferring rotation of the rotor 76 cannot occur until the anti-surge ratchet 200 is forwardly displaced sufficiently far to disengage the teeth 218 thereof from the corresponding rotor hub recesses 248. Towards this end, the rotor hub 192, the ratchet 198 and the anti-surge ratchet 200 are relatively configured so that with the ratchet rearward teeth 262 fully received into the corresponding hub recesses 248, but with the ratchet forward teeth 254 out of the corresponding anti-surge ratchet recess 222, and thus in sliding contact with the anti-surge ratchet rearward surface 220, the anti-surge ratchet teeth 218 are out of locking engagement with the corresponding rotor hub recesses 244.

Several degrees of initial main shaft 156 rotation is required to ramp the rotor forward teeth 254 out of the anti-surge ratchet recess 222, thereby pushing the anti-surge ratchet 200 forwardly out of locking engagement with the hub 192 and unlocking the rotor 76 for shell transferring rotation. Thus, the ratchet rearward teeth 262 and corresponding rotor hub recesses 248 are relatively configured to permit initial main shaft rotation, for example, of about 7 degrees before such ratchet teeth come into driving engagement with the rotor hub 192.

Accordingly, as operatively described below, although the rotor 76 (for the four cavity rotor illustrated) is rotated in 90° incremental steps, the main shaft 156, and hence the ratchet 198, is actually rotated (and must be then counterrotated) through 97° by the first actuation means 64 in order to provide the necessary rotor unlocking prior to rotor rotation.

Figure 10:
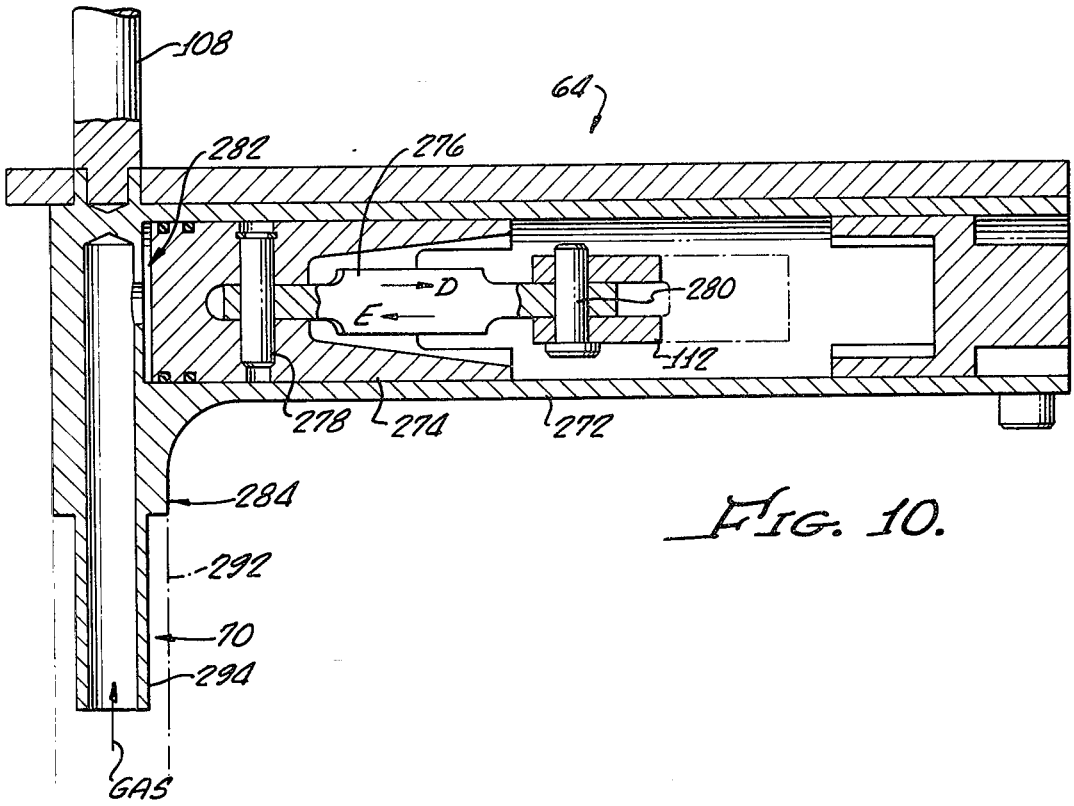
FIG. 10 is a cross sectional view, taken along line 10—10 of FIG. 4, showing features of the gas operated, first actuating means associated with the first stage feeding means.

As shown in FIG. 10, the first actuation means 64 includes a gas cylinder 272 having a piston 274 slidingly disposed therein. Opposite ends of a rigid, intermediate link 276 are pivotally connected to the piston 274 and to the crankarm 112, respectively, by first and second transverse pivot pins 278 and 280. Axial movement of the piston 274 in the cylinder 272 consequently causes, through the link 276, rotational movement of the crankarm 112 and, hence, the main shaft 156.

Pressurized barrel gas, caused by firing of the cannon 26, is fed into a gas chamber 282 in the cylinder 272, through an inlet 284 of the gas supply means 70, to cause axial movement of the piston 274, in the direction of Arrow "D", to rotate the rotor 76 in the shell advancing direction (Arrow "A", FIGS. 1, 8 and 9).

Other portions of the gas supply means 70 include a gas line 292 (FIGS. 2 and 10) interconnecting the inlet 284 to the barrel 58. Conventional quick-disconnect means (not shown) may be provided in the line 292 to permit easy removal of the feeder portion 44 from the cradle 32, as may sometimes be necessary. To accommodate cannon recoil and counterrecoil relative to the feeding apparatus 20, end portions 294 of the inlet 284 may be slidingly disposed, in gas sealing relationship, in the line 292.

Return axial movement (direction of Arrow "E") of the piston 274 after rotor indexing, is caused, through the main shaft 156, the crankarm 112 and the link 276, by spring action of the torsion bar 154.

Very rapid return rotation of the main shaft 156 is desirable so that the rotor 76 may be locked, through the rotor hub 198 and the anti-surge ratchet 200, against rotation before shell advancement from the supply means 24 into the rotor is completed to prevent rotor over travel. In addition, such rapid return rotation is preferred so the second stage feeding portion 62 may be unimpeded during operation by exerting any return forces on the crankarm 116, as might slow advancing of shells into the rotor 76.

To provide this rapid return rotation, in addition to the rotor shaft return rotation forces provided by the torsion bar 154, conventional gas venting means (not shown) are provided to vent high pressure gas in the cylinder chamber 282 when the rotor advancing stroke of the piston 272 is completed.

Figure 11:
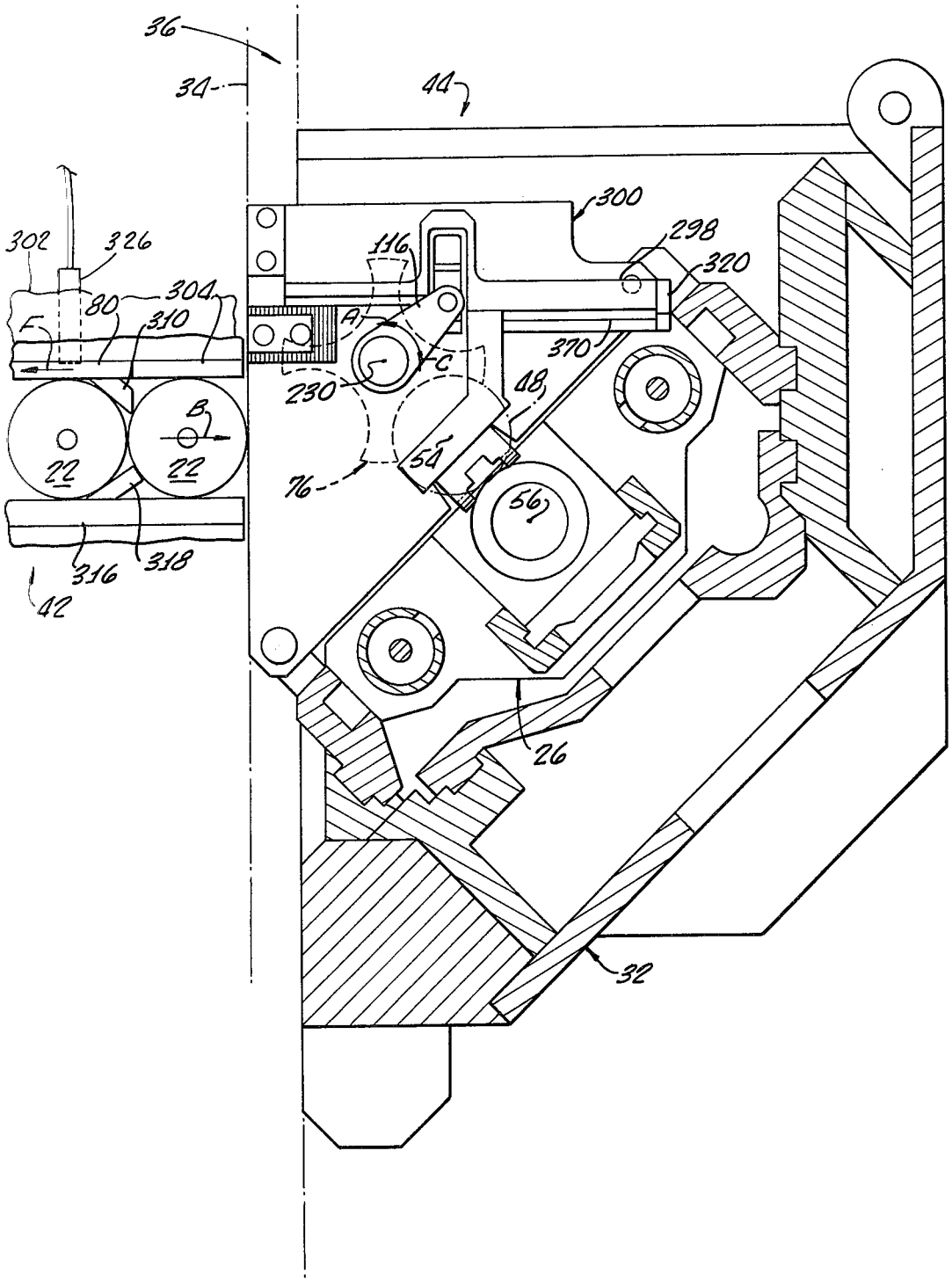
FIG. 11 is a partially cut away, transverse sectional view of the shell feeding apparatus, taken along line 11—11 of FIG. 2, showing the cradle of FIG. 2 closed against the turret side and showing the first and second stage shell feeding means in operative relationship with the shell supply means and the gun.

Spring compressing movement of portions of the second stage slide 80, is provided by a slide actuator 298, which forms part of the second actuation means 66 and is connected to the crankarm 116 (FIG. 11). Conventional means 300, mounted to the rear surface 114 of the rear plate 100, are provided for converting rotary movement of the crank 116 into linear movement of the slide actuator 298, and hence portions of the slide 80. Thus, rotational movement of the crank 116 in the rotor indexing direction of Arrow "A", causes linear outward spring compressing movement of the slide actuator 298 (Arrow "F"), for slide cocking purposes. Conversely, return rotation (direction of Arrow "C") of the crankarm 116 causes return movement (direction of Arrow "B") of the slide actuator.

Figure 12:
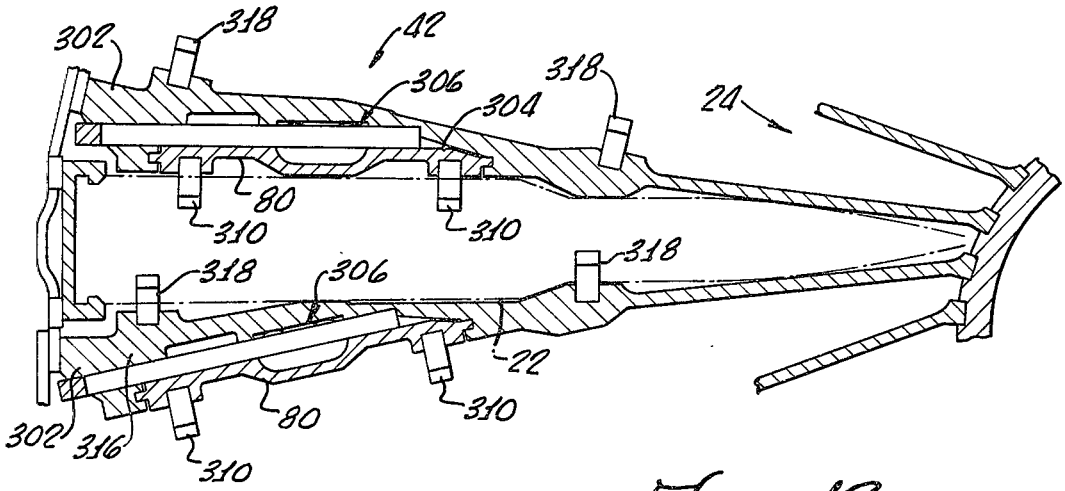
FIG. 12 is a transverse sectional view, taken along line 12—12 of FIG. 1, showing features of the shell advancing slide and shell supply vane.

Comprising the slide 80 are a fixed track 302 (FIGS. 1 and 12) mounted to, or formed as a part of, the drum segment 42; a linearly reciprocating, shell advancing portion 304, and spring means 306. Interconnecting the track 302 and the reciprocating portion 304, the spring means 306, which may comprise a side-by-side, pair of elongate compression springs 308, urge or bias the reciprocating portion towards the rotor 76 (in the direction of Arrow "B").

Pivotally connected to the reciprocating slide portion 304 are pairs of transversely spaced apart, spring loaded first shell advancing pawls 310. The number of pairs of the first pawls 310 corresponds to the number of the shells 22 which can be held in the drum segment 42, spacing of pairs of the pawls 310 corresponding to spacing between the shells (or shell positions) in the segment.

Spring mounting of the pairs of first pawls 310 is such that when the reciprocating portion 304 is pushed outwardly in the direction of Arrow "F" by the slide actuator 298, each of the pawls is upwardly deflected and rides over the adjacent shells, stroke of the reciprocating portion 304 being equal to, or only slightly greater than, a single shell spacing in the segment. During outward movement of the slide portion 304, after riding over the adjacent shell, the first pawls 310 pivot back downwardly into shell engaging position. Thus, on the return stroke of the sliding portion 304, caused by the spring means 306, all the shells 22 in the segment 42 are advanced by the pawls 110 one position towards the rotor 76, the shell closest to the rotor being thereby advanced or transferred into the adjacent one of the rotor cavities 78.

Backing up of the shells 22 in the segment 42, as the slide portion 304 is moved outwardly, is prevented by pairs of second, spring loaded pawls 318, which are mounted to upper regions of the below adjacent track 302. These pairs of second pawls 318, which correspond in number and spacing to the number and spacings of the first pawls 110, and hence of shell positions in the segment 42, are configured to deflect or retract downwardly under the shells 22, as the reciprocating slide portion 304 advances the shells towards the rotor 76. However, the extended second pawls 318 prevent movement of the shells away from the rotor 76, as might otherwise be caused by outward movement of the slide portion 304.

To enable charging of the cannon 26 prior to firing, by feeding two of the shells 22 into an initially empty rotor 76, an end 320 of the slide actuator 298 remote from the slide portion 304, is preferably configured for driving engagement by charging means (not shown). Starting with an empty rotor 76, two cyclings of the slide actuator 304 by the charging means advances two shells 22 from the segment 42 into adjacent rotor cavities 78, as is necessary for firing.

Searing up control of the bolt 30, as more particularly described below, may be provided by first and second shell sensing elements 324 and 326, respectively, (FIGS. 3, 4, 11 and 17) which may, for example, be of conventional microswitch or of Hall Effect type. As shown, the first shell sensing element 324 is mounted, through the second feed lip member 88, to sense presence of a shell in the shell pick up position 48. The second shell sensing element 326 is mounted through the fixed track 302, to sense presence of a shell is in the next-to-the-last (No. 9) shell feeding position relative to shell transferring into the rotor 76. In response to a first, simultaneous sensing of absence of shells by both the elements 324 and 326, searing up of the bolt 30 is signalled or initiated and firing ceases, as described below, with two shells in the rotor. Accordingly, no charging before a next firing is required.

At high bolt velocities, such as those associated with high firing rates enabled by the two stage shell feeding apparatus 20, high impact stresses can be caused when the bolt 30 picks up shells indexed into the pick up position 48 for stripping and loading. Since such impact is on a base 322 of the shell 22 (FIG. 6), high impact stresses can, if sufficiently great, cause detonation of the shell being picked up, with usually disastrous results. Less severe impact stresses may damage or deform a lower, shell base impact region 334 sufficiently to cause problems with shell casing extraction and ejection after firing. This results from the shell base impact region 334 being subsequently moved downwardly, as the shell 22 is loaded into the breech 52, into gripping engagement by a conventional bolt mounted extractor 336 which, during shell casing ejection after firing, also functions as a hinge point about which the ejected casing pivots. Impact damage to the base region 334 affects ability for the extractor to properly grip the shell base 332.

To eliminate shell base impact damage on pick up, the shell accelerator means 92 accelerates the shell 22 in the pick up position 48 to a velocity approximately equal to bolt velocity before bolt-shell engagement occurs. Comprising the accelerator means 92 is a housing 338 which is mounted to the rear plate surface 114 and in which the shell accelerator member 138 is pivotally mounted on a transverse pivot pin 340. Spring means 342 are provided between the housing 338 and the accelerator member 138 to urge the accelerator member into a shell engaging, intermediate position shown in FIG. 6, while permitting the accelerator member to pivot rearwardly and upwardly (direction of Arrow "H") about the pivot pin 340 in response to engagement by the recoiling bolt 30. Conventional spring loaded detent means 344 are provided for releasably retaining the accelerator member 138 in the intermediate position.

A forward, generally arcuate shell base engaging surface 346 of the accelerator member 138 is configured to cause an increasing velocity of the shell 22 during initial shell stripping. This enables controlled engagement between the accelerator surface 346 and the shell base 332 to be maintained, without bouncing, as the accelerator member 138 is pivoted forwardly (direction of Arrow "J") and the shell 22 is pushed forwardly (direction of Arrow "K").

Curvature of the accelerator surface 346, which can be rigorously developed by laying out a sequence of accelerator member and shell positions, can be closely approximated, to the extent normally required for satisfactory operation, by a single radius.

A lower, central region 348 of the accelerator member 138 is notched to permit passage of the volt mounted rammer 134. Function of the rammer 134 is to prevent bolt underride of the shell 22 being picked up from the pick up position 48 in the event the accelerator member 138 malfunctions of breaks. Under ordinary operation, the shell 22 is sufficiently moved ahead by bolt impact on the accelerator member 138 that by the time the bolt 30 reaches the shell, the shell base region 334 will have moved down into a bolt engagement position not requiring use of the rammer 134. Spring loading of the rammer 134 towards the upwardly extended, shell pick up position shown enables the rammer to pivot downwardly (direction of Arrow "L") as the bolt 30 recoils rearwardly under shells in the pick up position 48.

Side regions of the accelerator member surface 346 may be configured, in a manner not shown, for causing rearward pivoting of the accelerator member 138 to the intermediate position, from the forwardly pivoted position, in response to rotational indexing of the rotor 76.

As an alternative to the transversely pivoted accelerator member 138 shown, a correspondingly configured accelerator member may be pivotally mounted on a vertically disposed (as seen in FIG. 6) pivot pin in a manner not shown.

It is to be appreciated that for lower firing rates not resulting in damaging shell impact stresses, the accelerator means 92 may be eliminated, in which case, the rammer 134 is then operative for forwardly stripping the shell 22 from the pick up position 48.

As is typical of most automatic cannon, the longitudinal axis 54 through the shell pick up position 48 is parallel to, but offset from, (above in FIG. 13) the barrel bore axis 56 a radial distance "r", which may, for example, be about equal to a maximum shell diameter "d". Such shell offsetting is necessary to enable moving a shell into the pick up position 48 sufficiently rapidly to assure availability of a shell for picking up by the bolt 30 on counterrecoil, while still permitting relatively unimpeded bolt recoil past the pick up position. In practice, moving shells even a short distance inwardly towards the bore axis 56 after rotor indexing has proven to be very difficult and unreliable.

As a consequence of such off-bore axis positioning of the shell pick up position 48, shells stripped or rammed forwardly from the rotor 76 are required to move in a generally S-shaped feed path, indicated by the reference number 352 (FIG. 13), forwardly and inwardly towards the breech 52.

When the bolt stroke is short and bolt velocity is high, to achieve high cannon firing rates otherwise enabled by the two stage shell feeding apparatus 20, the feed path 352 is relatively sharply curved, since rearward positioning of the rotor 76 from the breech 52 is necessarily minimized. For example, for the exemplary cannon 26, a distance, "1", between a projectile nose end 354 of shells 22 in the pick up position (FIG. 13) and a rear face 358 of the breech 52 surrounding a breech opening 360 is between about 25–35 percent of overall shell length "L", depending upon breech recoil/counterrecoil position.

In fast firing automatic guns having high forward shell feeding velocities and short shell feed paths, corresponding to the path 352, problems frequently can occur in feeding shells from an offset pick up position into the breech. Magnitude and incidence of such problems are increased when breech recoil/counterrecoil movement causes the feed path length to vary from one firing to another. If, an an illustration, movement of the stripped shells is not adequately controlled along the feed path, the projectile may completely miss the breech opening and impact the surrounding breech surface. Ordinarily this causes gun jamming and may cause explosion of the shell. Or, when the projectile strikes the breech surface only a glancing blow before entering the breech opening, the projectile may be damaged to an extent adversely affecting weapon system effectiveness, particularly if the projectile is of a fused type.

Since feeding of shells 22, along the feed path 352, from the pick up position 48 into the breech 52, is an important adjunct to transferring shells from the supply means 24 into the pick up position, and to avoid or substantially reduce shell feed path related problems, control of shells moving along the feed path is provided. Such feed path control is enabled by configuring inner walls 362 of the rotor cavities 78, the feed lip members 86 and 88 and the deflector means 90 so that guiding engagement is maintained with the shells as the shells transverse the feed path 352 and until the shells are sufficiently far into the breech 52 that control is no longer needed.

Cooperating with the rotor cavity walls 362, feed lip members 86 and 88 and the deflector means 90 to provide shell control along the feed path 352 are means defining a U-shaped, shell base receiving slot or recess 370 at a forward face 372 of the bolt 30. The bolt face recess 370 is open in upper regions to enable entrance of the shell base 332. Lower, inner recess wall regions 374 stop inward movement of the shell base when the shell is generally aligned with the barrel bore axis 56. In addition, means defining a small, arcuate recess 376 inside the breech 52, in a shell casing shoulder abutting portion 378 thereof, may be provided for projectile nose end 354 clearance. The recess 376 is formed in lower regions (as seen in FIG. 13) of the breech where projectile nose ends 354 of shells 22 being loaded might otherwise hit a breech inner wall 380.

Depending, for example, upon such factors as the gun firing rate, the pick up position offset distance "r" and the distance "1" between the shell end 354 and the breech 52, either, or both, the breech recess 376 and the shell deflection means 90 may be unnecessary for providing adequate shell feed path control.

Figure 13:
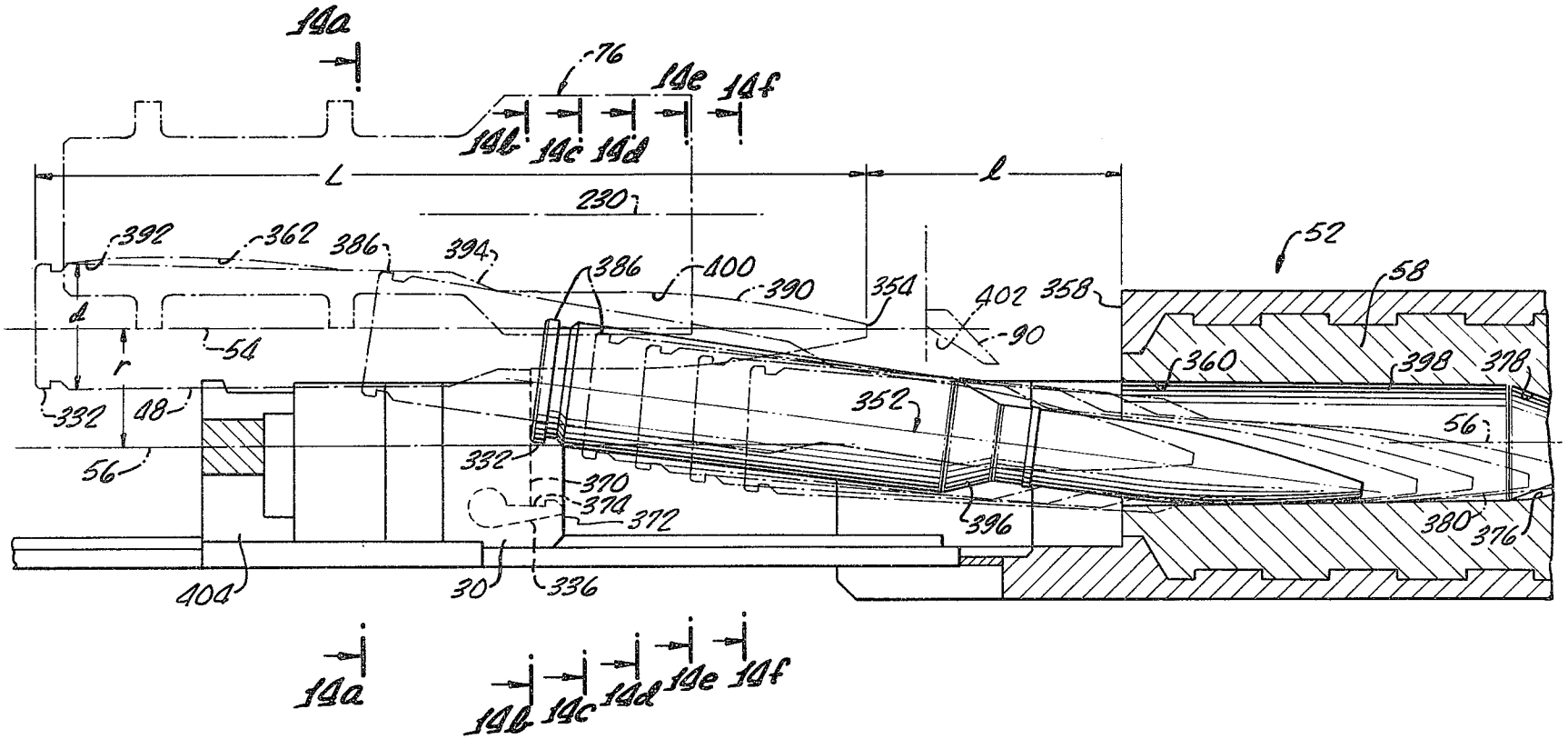
FIG. 13 is a cross sectional drawing taken generally in the plane of FIG. 6, showing layout of a shell feed path from the shell pick up position into the gun breech.

Configuration and contour of the rotor cavity wall 362, the feed lip members 86 and 88, the deflector means 90 and the breech recess 376 are determined, as shown in FIG. 13, by plotting or laying out a sequence of desired intermediate shell positions 386 between the pick up position 48 and a fully chambered shell position 388. This sequence of shell positions, in effect, defines the feed path 352.

Figure 14:
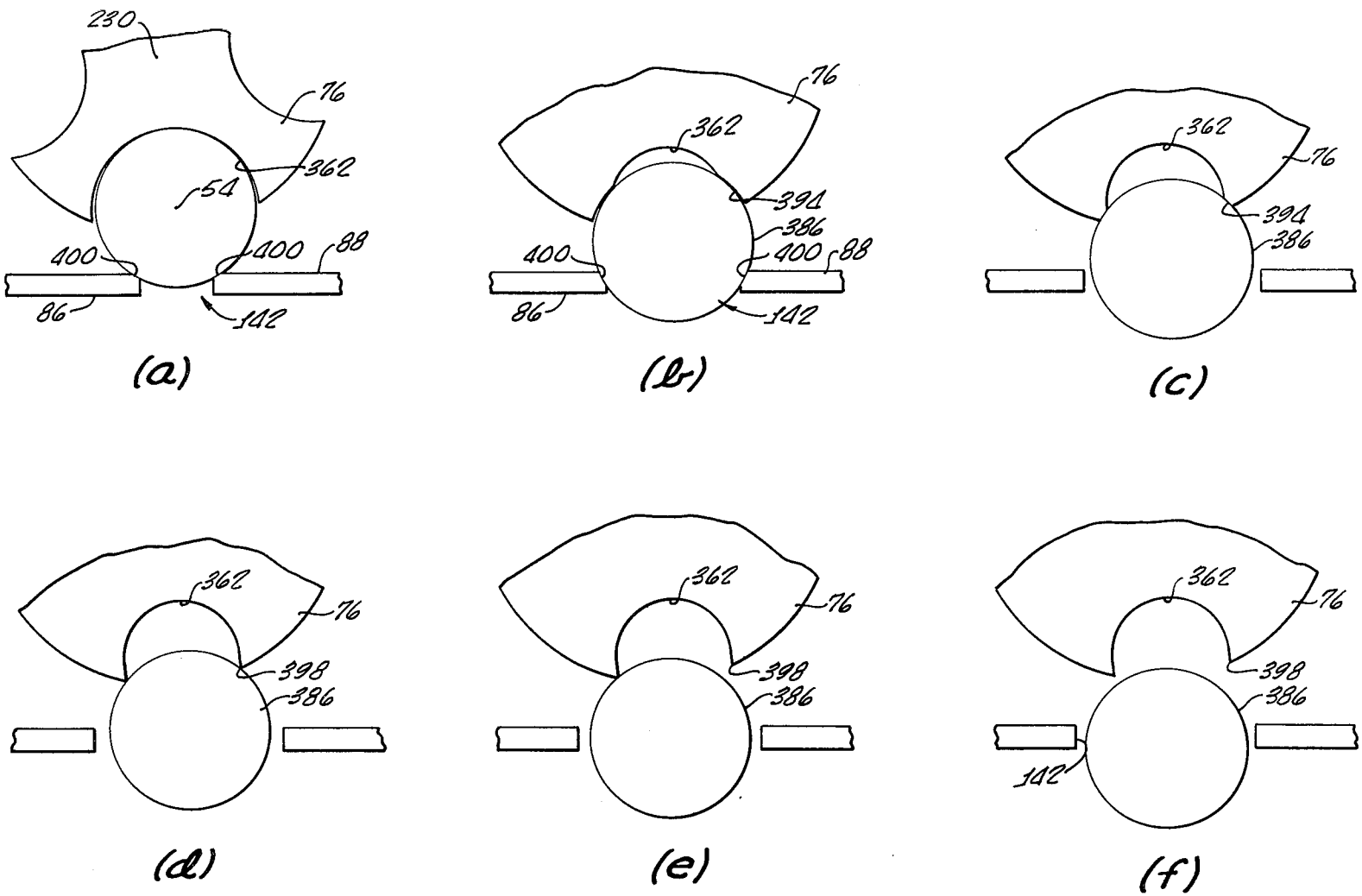
FIG. 14 is a series of transverse cross sectional views showing shell guiding along the shell feed path, FIGS. 14(*a*)–14(*f*) being taken along lines 14(*a*)–14(*a*) through 14(*f*)–14(*f*) of FIG. 13.

After the shell feed path 352 has been so defined, the cavity walls 362, the feed lip members 86 and 88 and the deflector means 90 are correspondingly configures so that, as shown in the various spaced apart cross sections of FIG. 14, shell guiding engagement is maintained until a shell projectile 390 is well inside the breech 52.

Contours of the rotor cavity walls 362 conform generally to those of the associated shells 22, so the shells 22 are relatively closely contained in the cavities 78 during rotational transporting. However, to reduce length of the feed path 352 by enabling the forwardly stripped shells 22 to be deflected towards the barrel bore axis 56 at a greater angle than would otherwise be possible, rearward cavity wall regions 392, 362 (FIG. 13) are gradually longitudinally bowed inwardly toward the axis 230 of the rotor. Accordingly, as the shells 22 are stripped forwardly and a cavity shoulder 394, corresponding to a necked down shoulder or projectile retaining region 396 on the shells 22, deflects the projectile nose end 354 inwardly towards the barrel bore axis 56 (FIGS. 14(*a*)–(*c*)), the shell base 332 is enabled to move slightly outwardly away from the bore axis into the bowed or recessed cavity region 392, 362 (FIG. 13). The bowed cavity region 392, 362 provides a guiding surface for smooth movement of the shell from the rotor cavity to the cannon firing chamber.

As shell stripping continues, upper surfaces of the shells 22 are guided along cavity edges or corner regions 398 (FIGS. 14(*d*) and (*e*)) of smaller radius cavity regions, which correspond to shell projectile radius. During such shell stripping movement, lower surfaces of the shells 22 are guided along opposing side edges 400 of the feed lip member intermediate gap region 140.

Downwardly and forwardly slping lower surfaces 402 (FIGS. 6 and 13) of the deflector means 90 are configured so that, as forward and inward shell movement continues, engagement between such surfaces and the shell shoulder 396 causes the shell base 332 to pivot inwardly towards the barrel bore axis 56 and into the bolt face recess 370. At this point, the shell base 332 passes freely downwardly between the feed lip members 86 and 88 in the gap region 142 (FIG. 14(*f*)). Lower central regions of the deflector means 90 are cut away to provide clearance for the shell rammer 134.

As the shell 22 pivots into alignment with the barrel bore axis 56, with the base 332 moving into full engagement with the bolt face recess 370, the projectile nose end 354 may pass through the breech block recess 376. When one of the shells 22 is completely chambered in the breech 52, continued forward movement of the bolt carrier 404 associated with the bolt 30 drives a firing pin 406 into firing engagement with the shell (FIG. 6).

It is to be appreciated that feeding of the shells 22 from the supply means 24 into the shell pick up position 48 in time for picking up by the bolt 30 on bolt counter-recoil, and subsequently controlling movement of the shells from the pick up position into the breech 52 for firing involve two related, but nevertheless relatively separable operations. Accordingly, the two stage feeding apparatus 20 can be employed to advantage even when no subsequent feed path control is required or other feed path control means are provided. Conversely, the described shell feed path control can be utilized on other types of guns not requiring the two stage feeding.

OPERATION

Operation of the two stage shell feeding apparatus 20 with shell acceleration and feed path control is generally appraent from the foregoing description of the apparatus.

Assume the bolt 30 is initially seared up rearwardly of the rotor 76 and a shell 22 is indexed into the pick up position 48. When unseared, the bolt 30 travels forwardly, driven by conventional recoil springs (not shown), and impacts the accelerator member 138 (FIG. 6) which, in turn, starts accelerating the shell forwardly from the pick up position 48 so that when the bolt 30 "catches up" with the shell base 332, impact therewith is reduced because of forward shell velocity.

After ramming the shell forwardly and inwardly along the feed path 352 (FIG. 13) into the breech 52, the shell 22 is fired by the bolt carrier mounted firing pin 406. As the projectile starts moving down the barrel 58, high pressure gases caused by propellant ignition, are directed by the gas supply means 70 to the chamber 282 (FIGS. 2 and 9) of the first actuation means 64, thereby driving the piston 274 outwardly (direction of Arrow "D"). In turn, the moving piston 274 causes rotation of the crankarm 112 and, hence, of the main shaft 156 and the ratchet 198 (direction of Arrow "A", FIGS. 2, 7 and 15).

Figure 15A:
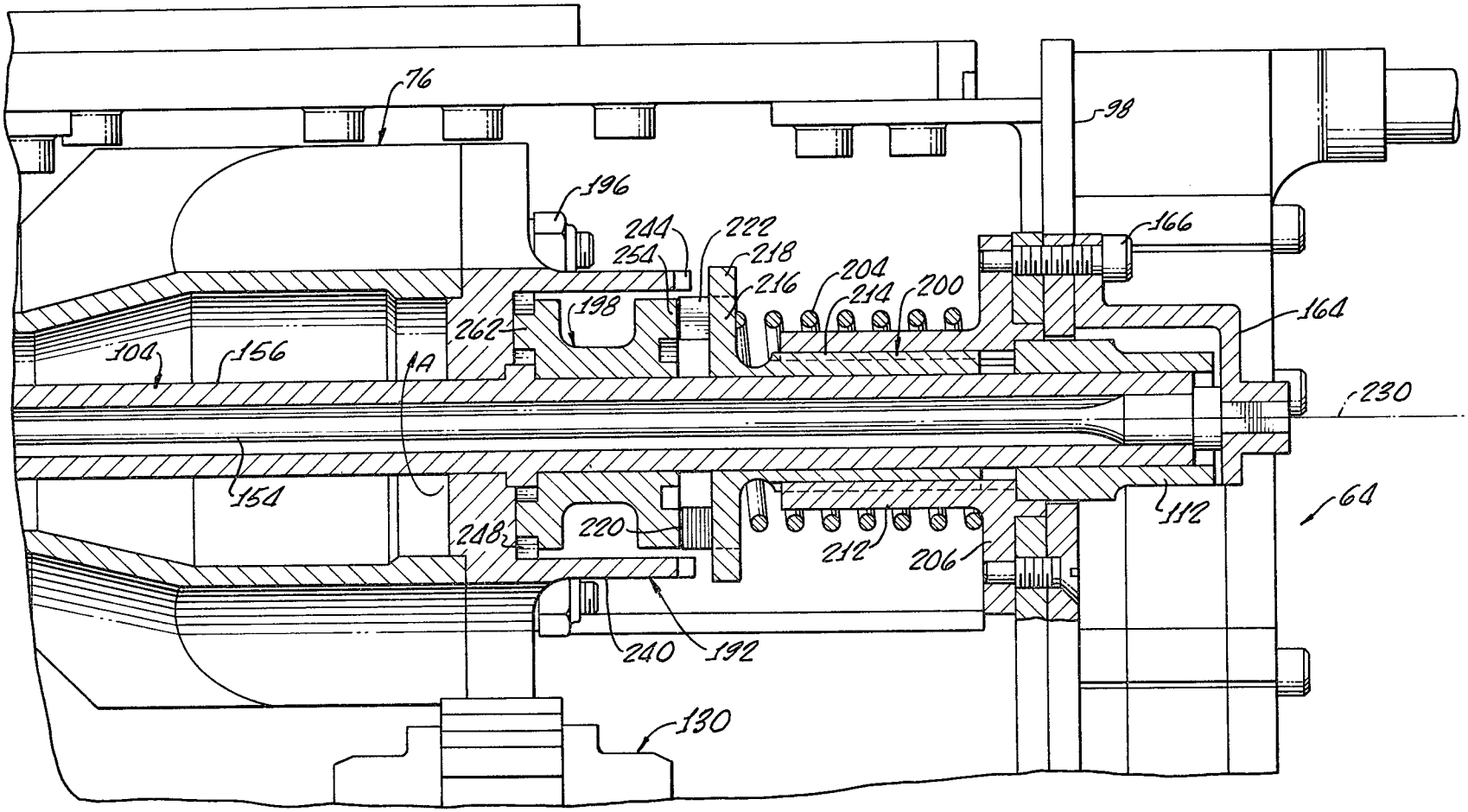
FIG. 15 is a series of two cross sectional views similar to FIG. 7, showing operation of the rotor ratchet and anti-surge means.
Figure 15B:
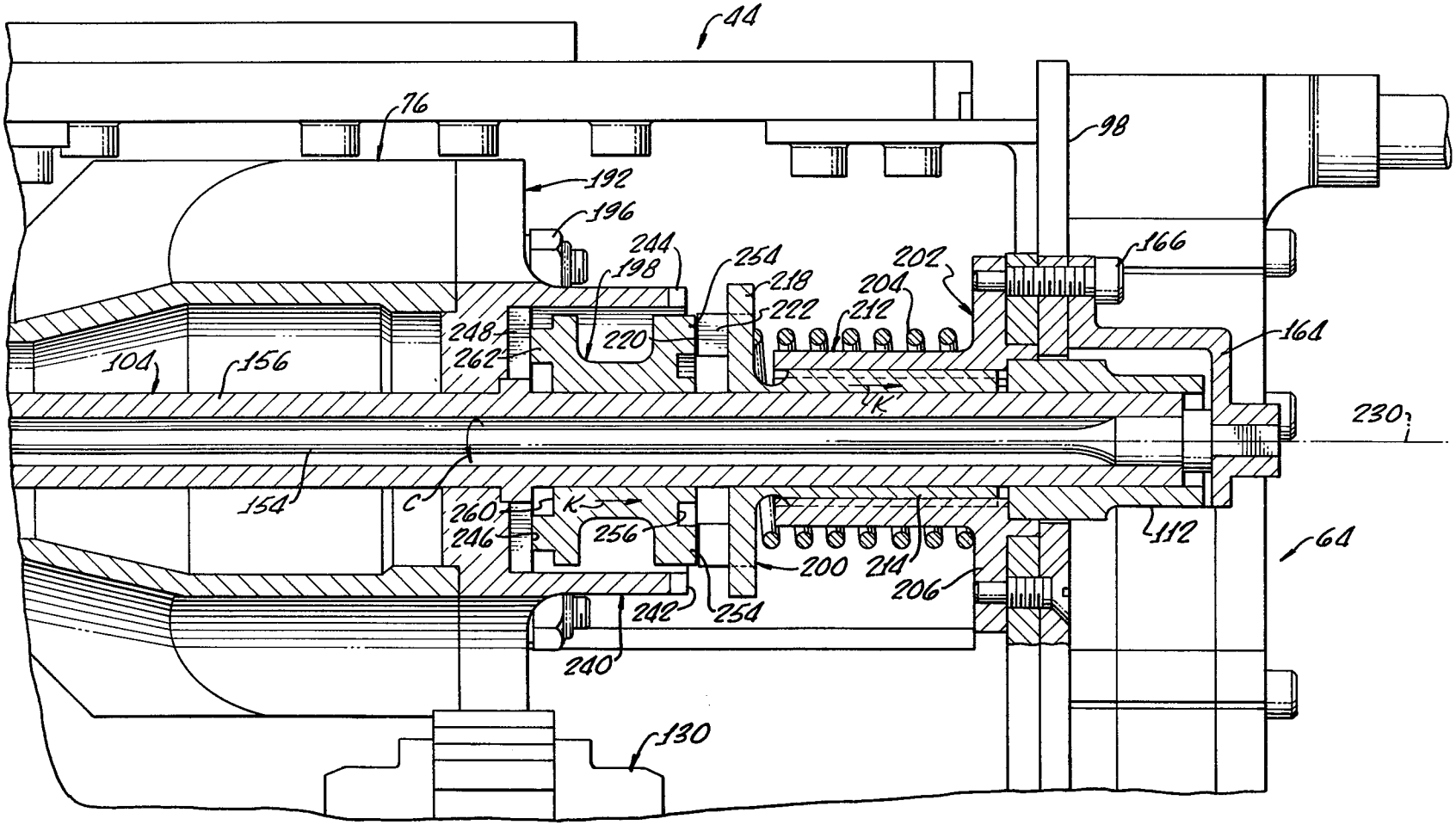

During the initial several degrees, for example, seven degrees of the main shaft and ratchet rotation, as the forward ratchet teeth 254 ramp out of the anti-surge ratchet recesses 222 (FIG. 15(*a*)), the ratchet 198 pushes the anit-surge ratchet 200 forwardly (direction of Arrow "K"), compressing the spring 204. As the anti-surge ratchet 200 is pushed forwardly in this manner by rotation of the main shaft 156 and the ratchet 198, the anti-surge ratchet teeth 218 are withdrawn from engagement with the corresponding rotor hub recesses 244. This unlocks the rotor 76 for 90° shell transferring rotation (direction of Arrow "A") during the remaining outward travel of the gas piston 274 and rotation of the crankarm 122 and the main shaft 156. After the rotor unlocking, the ratchet teeth 254 slide along the anti-surge ratchet rear surface 220.

Assuming one of the shells 22 was initially loaded into the rotor cavity 78 next adjacent to the pick up position 48 in the direction of rotor rotation, subsequent 90° rotor rotation indexes such shell into the shell pick up position before or during initial bolt recoil movement from the breech 52.

At the same time that the rotating crankarm 112 causes rotational indexing of the rotor 76, the crankarm 116, associated with the second actuation means 66 and fixed to the main shaft 156 for simultaneous rotation with the crankarm 112, causes outward, spring compressing movement of the slide portion 304, (direction of Arrow "F", FIGS. 1 and 11) through the actuating member 298.

After complete (97°) rotation of the main shaft 156 by the crankarm 112, barrel gas is vented from the gas chamber 282 and the torsion bar 154 causes rapid rerotation (direction of Arrow "C", FIG. 15(*b*)) of the main shaft and, hence, of the ratchet 198. However, reverse rotation of the rotor 76 (including the rotor hub 192) is prevented by the anti-back up means 130 (FIG. 9) which engage peripheral regions of the rotor 76. Return rotation of the main shaft 156 is enabled by the rear ratchet teeth 262 ramping up out of the corresponding rotor hub recesses 248, thereby pushing the ratchet 198 and the anti-surge ratchet 200 forwardly (direction of Arrow "K") against the spring 204. During return rotation of the main shaft 156 and the ratchet 198, the ratchet rear teeth 262 slide along the rotor hub recess bottom 246.

Upon completion of 97° return rotation of the main shaft 156 and the ratchet 198, the ratchet teeth 262 and 254 drop into the corresponding rotor hub and anti-surge ratchet recesses 248 and 222. When this occurs, the anti-surge ratchet 200 is driven rearwardly by the spring 204, moving the anti-surge ratchet teeth 218 back into rotor locking engagement with the rotor hub recesses 244.

This main shaft rerotation and consequent rotor locking occurs at least before complete transfer of a next shell from the magazine segment 42 into the rotor 76, thereby preventing continued, normal direction rotation of the rotor, as might otherwise be caused by pushing shells into the rotor cavities.

In response to the slide portion 304 being pushed outwardly (direction of Arrow "F", FIGS. 1 and 11), the pawls 310 mounted thereto ride up over corresponding ones of the shells 22, outward movement of the the shells in the segment 42 being prevented by the pawls 318 mounted to the fixed member 316. Outward movement of the slide portion 304 compresses the slide springs 308. Consequently, when the slide actuator 298 is returned (direction of Arrow "B") to its initial position by the crankarm 116, the springs 308 push the slide portion 304 back towards its initial position (also direction of Arrow "B"). As the slide portion 304 is returned, the attached pawls 310 push the shells 22 one shell position in the segment 42, thereby advancing the shell in the number 10 position adjacent the rotor 76 into the indexed, empty rotor cavity 78. During such shell advancing, the shells 22 deflect the fixed member pawls 318 downwardly to permit shell passage thereover.

As above mentioned, the first detent means 120 (FIG. 8) prevents overrotation of the rotor 76 during the first stage feeding operation by abutting the shell 22 indexed into the shell pick up position 48. Portions of the second detent means 122, which prevent the adjacent (end) shell 22 in the segment 42 from moving into rotor contact during first stage rotor turning, deflect or retract to enable shell advancing into the rotor cavity 78 during the second stage feeding operation by the slide portion 304.

During forward, counterrecoil bolt travel, the shell 22 now indexed into the pick up position 48 is stripped forwardly from the rotor 76 and moved along the feed path 352, as depicted in FIG. 13, into the breech 52 for firing by the bolt carrier mounted firing pin 404. Conventional means, not shown, are provided for locking the bolt 30 to the breech 52 during firing.

Operation of the apparatus 20 is further summarized diagramatically in FIGS. 16 and 17 in which the drum segment 42 is shown initially holding ten shells 22, numbered 1 through 10.

When the associated cannon is to be fired from an empty rotor condition, a double charging operation is required, during which the slide actuator 298 is mechanically cycled twice by conventional charging means (not shown). As the actuator 298 is pushed outwardly a first time (direction of Arrow "F", FIG. 16(*a*)), the empty rotor 76 is indexed one cavity position (direction of Arrow "A") and the sliding portion 304 is pushed outwardly (direction of Arrow "F"). As the slide springs 308 return the sliding portion 304 (direction of Arrow "B", FIG. 16(*b*)), to its initial position, the number "1" shell is advanced into the adjacent one of the rotor cavities 78.

Charging the actuator 298 a second time (FIG. 16(*c*)), rotates the rotor 76 another 90°, to index shell No. 1 into the shell pick up position 48 and pushes the sliding portion 304 outwardly again. Upon return movement of the sliding portion 304, shell No. 2 is advanced into the adjacent one of the rotor cavities 78 (FIG. 16(*d*)). At this point, the cannon 26 is ready for firing, assuming the bolt 30 is already seared up rearwardly of the pick up position 48.

Upon unsearing, the bolt 30, which is driven forwardly by conventional drive means (not shown), picks up shell No. 1 from the pick up position 48 (FIG. 16(*e*)), then pushing the shell fowardly into the breech and firing it. Immediately, in response to pressurized gases caused by firing shell No. 1, the rotor is rotated 90° (Arrow "A", FIG. 16(*f*)) to index shell No. 2 into the pick up position 48. Simultaneously, the sliding portion 304 is pushed outwardly (Arrow "F") compressing the slide springs 308. As the sliding portion 304 returns (Arrow "B"), shell No. 3 is advanced into the adjacent one of the rotor cavities 78 (FIG. 16(*g*)). By the time shell No. 3 is advanced into the adjacent rotor cavity 78, shell No. 2 will ordinarily already have been picked up by the counterrecoiling bolt for firing.

Since in combat situations the time required for the above described double charging operation may be critical, stopping of firing by bolt searing, for example, at the end of the burst, with the apparatus 20 in a fully charged condition with two shells left in the rotor 76 is necessary for an effective weapons system. Then, for a next firing all that is required is unsearing of the bolt 30.

FIG. 17 depicts the sequence by which ceasing firing with the apparatus 20 in the changed condition is accomplished. Assuming shell No. 7 has just been fired, in response thereto, the rotor 76 is rotated 90°, Indexing shell No. 8 into the pick up position 48 (FIG. 17(*a*)). The last shell No. 10 now occupies a next-to-the-last shell position in the segment 42; that is, the shell position initially occupied by shell No. 2. At that instant, as for corresponding instants associated with previous shell firings, the sensing means 324 and 326 still sense, respectively, presence of a shell (No. 8) in the pick up position 48 and a shell (No. 10) in the next-to-the-last segment position.

However, during the second stage portion of the feeding operation (FIG. 17(*b*)), after the bolt 30 strips shell No. 8 from the pick up position 48, shell No. 9 is completely transferred by the slide 80 into the rotor 76, thereby advancing shell No. 10 from the next-to-the-last segment position into the last segment position. Now, both the sensors 324 and 326 simultaneously sense no shells in either the pick up position or in the next-to-the-last segment position. In response, the sensors 324 and 326 provide electric signals to searing means (not shown) directing searing up of the bolt 30 the next time the bolt is at the searing position. The bolt is however, still moving forwardly in counterrecoil at this time with shell No. 8.

In response to firing shell No. 8, the rotor 76 is rotated 90° (FIG. 17(*c*)) to index shell No. 9 into the pick up position 48. Although the bolt 30 then sears up on counterrecoil, leaving shell No. 9 in the pick up position 48, shell No. 10 is still advanced into the rotor 76 (FIG. 17(*d*)) by the returning sliding portion 304. The feeding apparatus 20 is now in the fully charged condition of FIG. 16(*d*) with the bolt 30 seared up, and will be ready for firing again when a subsequent drum segment 42*a* (FIG. 17(*e*)), containing a second group of ten shells numbered 1'–10', is indexed into rotor feeding position.

It is to be appreciated, however, that whenever firing is interrupted during a burst, as determined by drum segment capacity, or if a continuous, belt-type shell supply were alternatively used, firing would automatically cease with two shells in the rotor 76 and the gun ready for firing even through there was no simultaneous sensing of empty positions by the sensors 324 and 326.

It is further to be appreciated, that when searing up is accomplished in the above described manner for ten shell segments 42, only eight shells are fired from the first segment, the ninth and tenth shells remaining in the rotor 76 after searing up. In subsequent firings, however, full ten shell bursts can be fired.

At the end of firing, the two shells 22 remaining in the rotor 76 may be removed, for example, by operation of the charging means or by opening the cradle 32 (FIG. 2) and pivoting open the feeder portion 44 and manually removing the shells from the rotor.

FIG. 18 depicts, by way of specific illustrative example, time sequence operation of the two stage feeding apparatus 20, showing relative displacement of the bolt 30 (FIG. 18(*a*)), the rotor 76 (FIG. 18(*b*)) and the shell sliding portion 304 (FIG. 18(*c*)), all plotted against a common time axis calibrated in milliseconds after firing. The plots of FIG. 18 were experimentally obtained for a 35 mm automatic cannon having a bolt assembly mass of about 20 pounds, an individual shell mass of about $3\frac{1}{2}$ pounds and a firing rate of approximately 600 rounds per minute or 100 milliseconds per round. A ten round capacity drum segment 42 was used. Stroke length of the bolt (corresponding to the bolt 30) and of the sliding portion (corresponding to the sliding portion 304) were about 22 inches and 2.5 inches respectively. Rotor indexing was 90° per shell fired.

As shown in FIG. 18(*a*), unlocking of the bolt 30 occurs during a time interval of about 5–15 milliseconds after firing, thereby enabling recoil movement of the bolt to start about 12 milliseconds after firing. Bolt-buffer 50 interaction occurs between about 47–53 milliseconds after firing. That is, the recoiling bolt impacts the buffer 50 about 47 milliseconds after firing, compressing spring elements in the buffer; at about 53 milliseconds after firing the bolt leaves the buffer in counter-recoil. Shell acceleration (by the acceleration means 90) occurs between about 55–59 milliseconds after firing, with shell ramming or movement along the feed path 352 occuring from about 59 to 95 milliseconds after firing.

From FIG. 18(*b*) it is seen that rotor rotation starts only about 5–6 milliseconds after firing, and 90° rotation thereof is completed only about 17–18 milliseconds after firing at a time when the bolt 30 has traveled only a few inches in recoil and nearly 40 milliseconds before the bolt counterrecoils to the shell acceleration position (FIG. 18(*a*)). Return ratchet rotation of the main shaft 156 and gas venting is completed by about the time the bolt 30 impacts the buffer 50.

Outward, cocking movement of the sliding portion 304 is seen from FIG. 18(*c*) to occur simultaneously with rotor rotation (FIG. 18(*b*)), as is expected because of the two crankarms 112 and 116 are fixed to the main shaft 156 (FIG. 6) to rotate in unison.

Shell transfer from the segment 42 into the rotor 76 is seen from FIG. 18(*c*) to be dependent upon the number of the shells 22 required to be simultaneously advanced the single shell position.

As is expected, complete transferring of one of the shells 22 from the segment 42 into the rotor 76 is slowest when the shell is the first shell of a ten shell segment. That is, shell transferring from the segment 42 into the rotor 76 is slowest, being completed about 68 milliseconds after firing, when ten shells, having a total mass of about 35 pounds, must be advanced by the slide springs 308. In contrast, when only one shell (the No. 10 shell) remains in the segment 42, transferring of such shell into the rotor 76 is completed about 43 milliseconds after firing.

In any event, it can be seen from FIGS. 18(*b*) and (*c*) that the rapid, first stage, rotor rotation of a shell into the pick up position 48, by about 17–18 milliseconds after firing, leaves about 82–83 milliseconds, or over four fifths of the cycle, for the second stage shell feeding.

Thus, for example, FIG. 18(*c*) indicates that with ten round segments, wherein both stages of the feeding cycle are completed about 68 milliseconds after firing, the two stage feeding apparatus 20 has potential for feeding shells from the segment 42 into the pick up position 48 at firing rates approximately 50 percent higher, or at firing rates of about 900 rounds per minute.

It should be appreciated that although the rotor 76 is shown and described as having four cavities 78 and as being rotatably indexed through 90° during each feeding cycle, different gun and shell supply arrangements, particularly if the feeding apparatus 20 is adapted for use with preexisting weapons systems, may dictate different rotational angles and different numbers of rotor cavities. For example, for some weapons systems, a three cavity rotor indexed through 120° may be more advantageous.

Since, however, rotational indexing speed of the rotor 76 is dependent to a large extent on rotational angle and mass to be rotated, including that of the shell or shells being rotated, percentage division of time between first and second stage shell feeding may vary from the illustrative example shown according to rotor configuration.

Although there has been described above a specific arrangement of two stage shell feeding apparatus with shell acceleration and feed path control for automatic cannon and the like, in accordance with the invention for purposes of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Shell feeding apparatus for an automatic gun having a shell supply means for containing shells to be fed into the gun and a bolt operative for axially reciprocating past a shell pick up position and picking up shells therefrom on forward bolt travel for loading into a gun firing chamber, the apparatus comprising:

(a) first stage shell feeding means for transferring shells from the shell supply means to the shell pick up position, said first stage feeding means including a shell rotor rotatably mounted on an axial rotor shaft, said shell rotor having surface regions defining a plurality of equally spaced apart, peripheral shell holding cavities;

(b) means for bidirectionally rotatably mounting the rotor shaft between the shell supply means and the shell pick up position, said mounting means positioning the shell rotor means relative to the shell supply means and the pick up position for causing, when any one of the rotor cavities is indexed into the shell pick up position, another one of the rotor cavities to be positioned in shell receiving relationship with the supply means;

(c) first stage actuation means, operated by pressurized gases caused by firing the gun, for causing, as the bolt is moving rearwardly after the gun is fired, partial rotation of the rotor to index a rotor cavity holding a shell into the shell pick up position to enable picking up of the shell by the bolt on forward bolt travel, and to simultaneously index an empty cavity into shell receiving relationship with the supply means;

said first stage actuating means including a first crankarm fixed to a first end of the rotor shaft, a gas cylinder having a piston connected to said crankarm for causing pivotal crankarm movement in response to piston movement and means for supplying pressurized gas from the gun barrel to the cylinder;

(d) second stage feeding means, operated by pressurized gases caused by firing of the gun, for causing, after the first stage feeding means has rotatably indexed the rotor and before a next firing of the gun, transfer of a shell from the shell supply means into the empty rotor cavity indexed therewith, said second stage feeding means including spring loaded shell advancing means connected to the shell supply means;

(e) second stage actuation means for actuating said second stage feeding means, including a second crankarm fixed to a second end of the rotor shaft and means for interconnecting the second crankarm with the shell advancing means to enable compressing of springs in the shell advancing means in response to pivotal movement of the second crankarm; and, (f) racheting means interconnecting the rotor with the rotor shaft for limiting rotational movement of the rotor to a single rotational direction, thereby enabling return rotation of the rotor shaft without rotational movement of the rotor.

2. The shell feeding apparatus according to claim 1, including means for limiting rotational movement of the rotor during indexing thereof by the first stage feeding means and preventing over travel of a shell cavity being indexed into the shell pick up position.

3. The shell feeding apparatus according to claim 1, including rotor anti-back up means for preventing reverse direction rotation of the rotor when a shell is transferred into the indexed empty rotor cavity by the second stage feeding means.

4. The shell feeding apparatus according to claim 1, including shell sensing means for providing an electrical signal indicating no shell in the shell pick up position, the shell sensing means includes means mounted in the shell supply means for providing an electrical signal indicating no shell in a next to the last shell transfer position relative to the rotor, said signals being adapted for causing searing up of the bolt upon simultaneous sensing of no shells in the pick up position and the next to the last transfer position.

5. Shell feeding apparatus for an automatic gun having shell supply means for containing shells to be fed and a gas operated bolt operative for axially reciprocating past a shell pick up position and picking up shells therefrom on forward bolt travel for loading into a gun firing chamber, the apparatus comprising:

(a) a first stage shell feeding rotor having surface regions defining a plurality of peripheral shell holding cavities equally spaced around the rotor;

(b) means for rotatably mounting the rotor between the shell supply means and the shell pick up position for enabling transfer of shells from the supply means into the shell pick up position, said mounting means positioning the rotor relative to the supply means and the pick up position for causing, when any one of the rotor cavities is indexed into the shell pick up position, another rotor cavity to be indexed into shell receiving relationship with the supply means;

(c) first stage actuation means for causing, as the bolt is moving rearwardly after the gun is fired, partial undirectional rotation of the rotor a single cavity position to index a rotor cavity holding a shell into the shell pick up position for enabling pick up of the shell by the bolt on forward bolt travel, and simultaneously to index a next adjacent empty cavity into shell receiving relationship with the supply means;

(d) second stage feeding means for transferring shells from the shell supply means into the rotor;

(e) second stage actuation means, responsive to firing of the gun, for actuating said second stage feeding means to cause, after the first stage actuation means has rotatably indexed the rotor and before a next firing of the gun, transferring of a shell from the shell supply means into the empty rotor cavity indexed therewith; and, (f) sensing means for sensing no shell in the rotor cavity indexed into the shell pick up position and no shell in a next to the last shell position, relative to shell transferring to the rotor, in the shell supply means and for providing an electrical signal adapted for initiating searing up of the bolt at a searing up position rearwardly of the pick up position the next time the bolt is in said searing up position, in response to sensing that the shell pick up position and the next to the last shell position are simultaneously empty of shells, the rotor being thereby caused to have shells in both the cavity indexed into the shell pick up position and in the next adjacent cavity indexed in shell receiving relationship with the shell supply means when the bolt is seared up and ready for a next firing.

6. The shell feeding apparatus according to claim 5, wherein the first and second stage feeding means are operated by high pressure barrel gases caused by firing of the gun.

7. The shell feeding apparatus according to claim 5, wherein the mounting means includes a rotor mounting shaft and racheting means interconnecting the rotor with the shaft for limiting rotation of the rotor about the shaft to a single rotational direction, said mounting means enabling bidirectional rotation of the rotor shaft, and wherein the first stage feeding means includes a gas cylinder having a piston, a crankarm fixed to one end of the rotor mounting shaft and means pivotally interconnecting the piston to the crankarm, and further including means for supplying pressurized barrel gases to the cylinder to cause movement of the piston, and hence rotation of the rotor mounting shaft and rotor indexing in response to firing of the gun.

8. The shell feeding apparatus accoding to claim 7, wherein the second stage feeding means includes spring activated shell advancing means for advancing a plurality of shells in the supply means towards the rotor and wherein the second stage actuation means a second crankarm fixed to a second end of the rotor mounting shaft and means causing compression of springs in the spring activated shell advancing means in response to pivoting of the second crankarm as the rotor shaft is rotated by the first stage shell actuation means.

9. The shell feeding apparatus according to claim 8, wherein the rotor mounting shaft includes a tubular main shaft having a torsion bar disposed therethrough, said torsion bar being fixed against rotation at a first end and nonrotatably connected to the main shaft at a second end, said first mentioned crankarm and said second crankarm being fixed to opposite ends of the main shaft.

10. Shell feeding apparatus for a gun having shell supply means for containing shells to be fed into the gun and a bolt operative for axially reciprocating past a shell pick-up position and for picking up shells therefrom on forward bolt travel for loading into a gun firing chamber, the apparatus comprising:

(a) shell transferring means for transporting shells from the shell supply means to the shell pick-up position, said transferring means including means defining at least one cavity configured for holding a shell transferred into the shell pick-up position until the shell is picked up therefrom by the bolt; and, (b) shell accelerating means disposed rearwardly of said shell pick-up position and in the path of bolt forward travel for causing, in response to engagement by the bolt on forward travel thereof, forward acceleration of a shell in the pick-up position to substantially bolt velocity before engagement between the bolt and said shell, impact forces between the bolt and the shell being thereby substantially reduced over that which would otherwise occur in the absence of the accelerating means.

11. The shell feeding apparatus according to claim 10, wherein said shell accelerating means comprises a shell accelerating element and means pivotally mounting said element rearwardly of a shell in the shell pick-up position and along a path of bolt travel, said element being formed having a forward, convex shell base engaging surface and a bolt engagement portion, forward impact by the bolt against said engagement portion causing the element to pivot forwardly and said shell base engaging surface to drive said shell forwardly ahead of the bolt, said pivotal mounting means enabling said element to pivot rearwardly in response to impact by the bolt on rearward recoil movement thereof after firing to thereby enable the bolt to travel rearwardly past said element.

12. The shell feeding apparatus according to claim 11, including means for causing the shell accelerating element to return to a central position in readiness for shell acceleration after said element has been pivoted either forwardly by forward movement of the bolt or rearwardly by rearward movement of the bolt.

13. The shell feeding apparatus according to claim 11, wherein said shell base engaging surface is contoured to enable contact to be maintained between said surface and the shell base without bouncing as the accelerator element is pivoted forwardly by the bolt to cause shell acceleration.

14. Shell feeding apparatus, for a gun having shell supply means for containing shells to be fed into the gun and a bolt operative for axially reciprocating past a shell pick up position and picking up shells therefrom on forward bolt travel for loading into a gun firing chamber, the apparatus comprising:

(a) a first stage shell feeding rotor having surface regions defining a plurality of peripheral shell holding cavities, the cavities being spaced apart around the rotor;

(b) means for rotatably mounting the rotor for enabling transfer thereby of shells from the supply means into the shell pick up position, said mounting means including a rotor shaft on which the rotor is rotatably mounted for positioning the rotor relative to the shell supply means and the shell pick up position for causing, when any one of the rotor cavities is indexed into the shell pick up position, another one of the rotor cavities to be positioned in shell receiving relationship with the supply means;

(c) first stage actuating means operated by pressurized gases caused by firing of the gun, for causing, as the bolt moves rearwardly after the gun is fired, partial rotation of the rotor to index a rotor cavity holding a shell into the shell pick up position to enable picking up of the shell by the bolt on forward bolt travel, and simultaneously to index an empty cavity into shell receiving relationship with the supply means;

(d) second stage shell feeding means, operated by pressurized gases caused by firing of the gun, for causing, after the first stage actuating means has rotatably indexed the rotor and before a next firing of the gun, transfer of a shell from the shell supply means into the empty rotor cavity indexed therewith;

(e) anti-surge means for locking the rotor against rotational movement during shell transferring of a shell from the supply means into said empty rotor cavity by the second stage feeding means, said anti-surge means being axially slidably and non-rotatably mounted on said rotor shaft; and, (f) means for causing unlocking between the rotor and the anti-surge means before subsequent partial rotation of the rotor by the first stage feeding means in response to a next firing of the gun, said unlocking means including ratchet means being disposed between the rotor and anti-surge means and being responsive to initial rotation of the rotor shaft for pushing the anti-surge means out of locking engagement with the rotor, thereby unlocking the rotor for shell indexing rotation thereof by the rotor shaft.

15. Shell feeding apparatus, for a gun having shell supply means for containing shells to be fed into the gun and a bolt operative for axially reciprocating past a shell pick up position and picking up shells therefrom on forward bolt travel for loading into a gun firing chamber, the apparatus comprising:

(a) a first stage shell feeding rotor having surface regions, defining a plurality of peripheral shell holding cavities, the cavities being spaced apart around the rotor;

(b) means for rotatably mounting the rotor for enabling transfer thereby of shells from the supply means into the shell pick up position, said mounting means positioning the rotor relative to the shell supply means and the shell pick up position for causing, when any one of the rotor cavities is indexed into the shell pick up position, another one of the rotor cavities to be positioned in shell receiving relationship with the supply means;

said mounting means including a rotor shaft mounted for bidirectional rotation, the rotor being rotatably mounted on said shaft, said mounting means further including means for limiting rotor rotation on said shaft to a single shell indexing direction and including ratchet means for interconnecting the rotor to the rotor shaft for enabling shell indexing rotation of the rotor by the rotor shaft;

(c) first stage actuating means operated by pressurized gases caused by firing of the gun, for causing, as the bolt moves rearwardly after the gun is fired, partial rotation of the rotor to index a rotor cavity holding a shell into the shell pick up position to enable picking up of the shell by the bolt on forward bolt travel, and simultaneously to index an empty cavity into shell receiving relationship with the supply means; and (d) second stage shell feeding means, operated by pressurized gases caused by firing of the gun, for causing, after the first stage actuating means has rotatably indexed the rotor and before a next firing of the gun, transfer of a shell from the shell supply means into the empty rotor cavity indexed therewith.

16. The shell feeding apparatus according to claim 15, wherein the first stage actuating means is connected to a first end of the rotor shaft and including second stage actuating means for actuating said second stage feeding means, said second stage actuating means being connected to the second end of the rotor shaft.

17. Shell feeding apparatus, for a gun having shell supply means for containing shells to be fed into the gun and a bolt operative for axially reciprocating past a shell pick up position and picking up shells therefrom on forward bolt travel for loading into a gun firing chamber, the apparatus comprising:

(a) a first stage shell feeding rotor having surface regions defining a plurality of peripheral shell holding cavities, the cavities being spaced apart around the rotor;

(b) means for rotatably mounting the rotor for enabling transfer thereby of shells from the supply means into the shell pick up position, said mounting means positioning the rotor relative to the shell supply means and the shell pick up position for causing, when any one of the rotor cavities is indexed into the shell pick up position, another one of the rotor cavities to be positioned in shell receiving relationship with the supply means;

(c) first stage actuating means operated by pressurized gases caused by firing of the gun, for causing, as the bolt moves rearwardly after the gun is fired, partial rotation of the rotor to index a rotor cavity holding a shell into the shell pick up position to enable picking up of the shell by the bolt on forward bolt travel, and simultaneously to index an empty cavity into shell receiving relationship with the supply means;

(d) second stage shell feeding means, operated by pressurized gases caused by firing of the gun, for causing, after the first stage actuating means has rotatably indexed the rotor and before a next firing of the gun, transfer of a shell from the shell supply means into the empty rotor cavity indexed therewith; and, (e) shell accelerating means responsive to the bolt on forward travel thereof for causing acceleration of a shell in the shell pick up position prior to engagement between the bolt and said shell, forces of impact between the bolt and the shell and possibility of shell impact damage being thereby substantially reduced over those occurring without the accelerating means.

18. Shell feeding apparatus for a gun having shell supply means for containing shells to be fed into the gun and a bolt operative for axially reciprocating past a shell pick up position which is offset from a barrel bore axis and picking up shells therefrom on forward bolt travel for loading into a gun firing chamber, the apparatus comprising:

(a) a first stage shell feeding rotor having surface regions defining a plurality of peripheral shell holding cavities, the cavities being equally spaced apart around the rotor;

(b) means for rotatably mounting the rotor for transferring shells from the shell supply means to the shell pick up position, said mounting means positioning the rotor relative to the shell supply means and the pick up position for causing, when any one of the rotor cavities is indexed into the shell pick up position, another one of the rotor cavities to be positioned in shell receiving relationship with the supply means;

(c) shell retaining means mounted intermediate the rotor and the gun adjacent to the shell pick up position for retaining in the rotor a shell contained in whichever rotor cavity is indexed into the shell pick up position, said retaining means permitting forward extraction of the shell from said indexed cavity by the bolt on forward travel thereof past the shell pick up position, said rotor surface regions defining the shell holding cavities and said shell retaining means both having shell engaging surface regions cooperatively configured for providing controlled forward and inward shell feeding movement as a shell picked up from the cavity indexed into the shell pick up position is driven by the bolt towards the firing chamber;

(d) first stage actuating means, operated by firing of the gun, for causing, as the bolt moves rearwardly after the gun is fired, partial rotation of the rotor to index a rotor cavity holding a shell into the shell pick up position and to simultaneously index an empty cavity into shell receiving relationship with the supply means;

(e) second stage feeding means for transferring shells from the shell supply means into the rotor;

(f) second stage actuating means, responsive to firing of the gun, for actuating said second stage feeding means to cause, after the first stage actuating means has rotatably indexed the rotor and before a next firing of the gun, transferring of a shell from the shell supply means into the empty rotor cavity indexed therewith; and (g) shell accelerating means responsive to the bolt on forward travel thereof for causing acceleration of a shell in the shell pick up position prior to engagement between the bolt and said shell, forces of impact between the bolt and the shell and possibility of shell impact damage being thereby substantially reduced over those occurring without the accelerating means.

19. Shell feeding apparatus, for an automatic gun having a shell supply means for containing shells to be fed into the gun and a bolt operative for axially reciprocating past a shell pick up position and picking up shells therefrom on forward bolt travel for loading into a gun firing chamber, the apparatus comprising:

(a) first stage shell feeding means for transferring shells from the shell supply means to the shell pick up position, said first stage feeding means including a shell rotor rotatably mounted on an axial rotor shaft, said shell rotor having surface regions defining a plurality of equally spaced apart, peripheral shell holding cavities;

(b) means for bidirectionally rotatably mounting the rotor shaft between the shell supply means and the shell pick up position, said mounting means positioning the shell rotor means relative to the shell supply means and the pick up position for causing, when any one of the rotor cavities is indexed into the shell pick up position, another one of the rotor cavities to be positioned in shell receiving relationship with the supply means;

(c) first stage actuating means, operated by pressurized gases caused by firing the gun, for causing, as the bolt is moving rearwardly after the gun is fired, partial rotation of the rotor to index a rotor cavity holding a shell into the shell pick up position to enable picking up of the shell by the bolt on forward bolt travel, and to simultaneously index an empty cavity into shell receiving relationship with the supply means;

said first stage actuating means including a first crankarm fixed to a first end of the rotor shaft, a gas cylinder having a piston connected to said crankarm for causing pivotal crankarm movement in response to piston movement and means for supplying pressurized gas from the gun barrel to the cylinder;

(d) second stage feeding means, operated by pressurized gases caused by firing of the gun, for causing, after the first stage feeding means has rotatably indexed the rotor and before a next firing of the gun, transfer of a shell from the shell supply means into the empty rotor cavity indexed therewith, said second stage feeding means including spring loaded shell advancing means connected to the shell supply means;

(e) second stage actuating means for actuating said second stage feeding means, including a second crankarm fixed to a second end of the rotor shaft and means for interconnecting the second crankarm with the shell advancing means to enable compressing of springs in the shell advancing means in response to pivotal movement of the second crankarm;

(f) racheting means interconnecting the rotor with the rotor shaft for limiting rotational movement of the rotor to a single rotational direction, thereby enabling return rotation of the rotor shaft without rotational movement of the rotor; and (g) shell accelerating means responsive to the bolt on forward travel thereof for causing acceleration of a shell in the shell pick up position prior to engagement between the bolt and said shell, forces of impact between the bolt and the shell and possibility of shell impact damage being thereby substantially reduced over those occurring without the accelerating means.

20. Shell feeding apparatus, for an automatic gun having shell supply means for containing shells to be fed and a gas operated bolt operative for axially reciprocating past a shell pick up position and picking up shells therefrom on forward bolt travel for loading into a gun firing chamber, the apparatus comprising:

(a) a first stage shell feeding rotor having surface regions defining a plurality of peripheral shell holding cavities equally spaced around the rotor;

(b) means for rotatably mounting the rotor between the shell supply means and the shell pick up position for enabling transfer of shells from the supply means into the shell pick up position, said mounting means positioning the rotor relative to the supply means and the pick up position for causing, when any one of the rotor cavities is indexed into the shell pick up position, another rotor cavity to be indexed into shell receiving relationship with the supply means;

(c) first stage actuating means for causing, as the bolt is moving rearwardly after the gun is fired, partial undirectional rotation of the rotor a single cavity position to index a rotor cavity holding a shell into the shell pick up position for enabling pick up of the shell by the bolt on forward bolt travel, and simultaneously to index a next adjacent empty cavity into shell receiving relationship with the supply means;

(d) second stage shell feeding means for transferring shells from the shell supply means into the rotor;

(e) second stage actuating means, responsive to firing of the gun, for actuating said second stage feeding means to cause, after the first stage actuating means has rotatably indexed the rotor and before a next firing of the gun, transferring of a shell from the shell supply means into the empty rotor cavity indexed therewith;

(f) sensing means for sensing no shell in the rotor cavity indexed into the shell pick up position and no shell in a next to the last shell position, relative to shell transferring to the rotor, in the shell supply means, and for providing an electrical signal adapted for initiating searing up of the bolt at a searing up position rearwardly of the pick up position the next time the bolt is in said searing up position, in response to sensing that the shell pick up position and the next to the last shell position are simultaneously empty of shells, the rotor being thereby caused to have shells in both the cavity indexed into the shell pick up position and in the next adjacent cavity indexed in shell receiving relationship with the shell supply means when the bolt is seared up and ready for a next firing; and (g) shell accelerating means responsive to the bolt on forward travel thereof for causing acceleration of a shell in the shell pick up position prior to engagement between the bolt and said shell, forces of impact between the bolt and the shell and possibility of shell impact damage thereby substantially reduced over those occurring without the accelerating means.

21. The shell feeding apparatus according to claim 17, 18, 19 or 20, wherein said shell accelerating means comprises a shell accelerating element and means pivotally mounting said element rearwardly of a shell in the shell pick-up position and along a path of bolt travel, said element being formed having a forward, convex shell base engaging surface and a bolt engagement portion, forward impact by the bolt against said bolt engagement portion causing the element to pivot forwardly and said shell base engaging surface to drive said shell forwardly ahead of the bolt, said pivotal mounting means enabling said element to pivot rearwardly in response to impact by the bolt on rearward recoil movement thereof after firing to thereby enable the bolt to travel rearwardly past said element.

22. The shell feeding apparatus according to claim 21, including means for causing the shell accelerating element to return to a central position in readiness for shell acceleration after said element has been pivoted either forwardly by forward movement of the bolt or rearwardly by rearward movement of the bolt.

23. The shell feeding apparatus according to claim 21, wherein said shell base engaging surface is contoured to enable contact to be maintained between said surface and the shell base without bouncing as the accelerator element is pivoted forwardly by the bolt to cause shell acceleration.

24. Shell feeding apparatus for a high rate of fire automatic cannon, said cannon having a bolt operative for axially reciprocating past a loaded shell pick up position which is offset from the barrel bore axis of the cannon, to sequentially pick up shells therefrom on forward bolt travel for sequentially loading the same into a cannon firing chamber, said shell feeding apparatus comprising:

(a) a shell feeding rotor having surface regions defining a plurality of peripheral shell holding cavities, the cavities being spaced apart around the rotor;

(b) shell supply means for supplying shells, as free shells, to the rotor;

(c) means rotatably mounting the rotor for enabling transfer of free shells from the supply means into the shell pick up position, said mounting means positioning the rotor relative to the shell supply means and the shell pick up position for causing, when any of the rotor cavities is indexed into the shell pick up position, another one of the rotor cavities to be positioned in shell receiving relationship with the supply means;

(d) a relatively fast actuating means for partially rotating the rotor to index a rotor cavity holding a free shell into the shell pick up position upon firing of the cannon and prior to the recoiling bolt moving rearwardly of the shell pick up position, said fast actuating means being operated by pressurized gases caused by firing of the cannon; and, (e) a relatively slow shell feeding means for advancing a plurality of shells in the supply means toward the rotor and for transferring a free shell from the supply means into the empty rotor cavity indexed with the supply means, after said actuating means has rotatably indexed the rotor and before the next shell is fired.

25. The apparatus of claim 24, wherein the spacing of the shell cavities around the rotor, the means rotatably mounting the rotor and the relatively fast actuating means are structured to cause, when any one of the rotor cavities is indexed into the shell pick up position, the next adjacent rotor cavity to be positioned in shell receiving relationship with the supply means, whereby upon partial rotation by the actuating means, the rotor is required to move only a single free shell so as to reduce inertia and enhance speed.

26. The apparatus of claim 24, wherein the shell axis in the shell pick up position is sufficiently offset from the bore axis of the cannon that the body of the reciprocating bolt clears the shell loaded into the pick up position upon recoil, and wherein the bolt has a spring loaded rammer which protrudes therefrom on counter-recoil so as to be capable of engaging the rear of a shell in the pick up position during counter-recoil of the bolt.

27. The apparatus of claim 24, wherein the relatively fast actuating means for partially rotating the rotor includes means for effectively locking the rotor against further rotation by the free shell transfer action of the relatively slow shell feeding means.

28. The apparatus of claim 24, wherein the relatively fast actuating means for the rotor is operatively coupled to the relatively slow shell feeding means for the shell supply means, and wherein the coupling between the actuating means and shell feeding means produces, upon each sequential firing of a shell by the cannon, sequential operation, first of the actuating means to partially rotate the rotor within approximately the first twenty-five percent of the time cycle between sequential shell firings during automatic cannon firing, and thereafter and secondly within the same time cycle, the positive shell advancement of and free shell transfer to the rotor of the shell feeding means during the remainder of the time cycle.

29. The apparatus of claim 28, wherein the shell supply means includes means for supporting a plurality of shells, and the shell feeding means includes spring means for advancing said plurality of shells within the supply means and for transferring a free shell to the rotor, and wherein the coupling between the actuating means and shell feeding means operates to charge the spring means upon operation of the actuating means to produce partial rotation of the rotor.

30. The apparatus of claim 24, wherein the shell feeding apparatus includes free shell retaining means mounted intermediate the rotor and the cannon adjacent the shell pick up position for retaining in the rotor a free shell disposed in whichever rotor cavity is indexed into the shell pick up position, said shell retaining means including first and second diverging feed lip members laterally spaced apart by an increasing distance going toward the front of the pick up position, whereby a free shell is retained in the rotor but may be forwardly stripped from and away from the rotor to the offset barrel bore axis of the cannon, said forwardly diverging feed lips being spaced and contoured to continuously engage and guide the forwardly stripped shell toward the cannon firing chamber along a substantial portion of its path.

31. The apparatus of claim 30, wherein each rotor cavity surface approximately matches the external configuration of a free shell along the shell length around a substantial part of the shell perimiter, but is gradually longitudinally bowed inwardly toward the axis of the rotor along its rearward portion to facilitate a short shell feeding path, while providing a guiding surface for smooth movement of the shell from the rotor cavity to the cannon firing chamber.

* * * * *

UNITED STATES PATENT AND TRADEMARK OFFICE

CERTIFICATE OF CORRECTION

PATENT NO. : 4,348,938

DATED : September 14, 1982

INVENTOR(S) : Richard R. Gillum

It is certified that error appears in the above—identified patent and that said Letters Patent is hereby corrected as shown below:

| | | |
|---|---|---|
| Column 4, | line 13 | delete the first "free" |
| Column 9, | line 12 | after "into" insert --an-- |
| Column 10, | line 8 | change "adapted" to --adaptable-- |
| Column 18, | line 47 | change "volt" to --bolt-- |
| Column 20, | line 66 | change "slping" to --sloping-- |
| Column 22, | line 2 | change "122" to --112-- |
| Column 23, | line 67 | change "Indexing" to --indexing-- |
| Column 25, | line 18 | after "firing" insert a dash |
| Column 34, | line 26 | after "damage" insert --being-- |

Signed and Sealed this

*Twenty-first* Day of *December 1982*

[SEAL]

*Attest:*

GERALD J. MOSSINGHOFF

*Attesting Officer*

*Commissioner of Patents and Trademarks*